US006501456B1

(12) United States Patent
Saito et al.

(10) Patent No.: US 6,501,456 B1
(45) Date of Patent: Dec. 31, 2002

(54) LIQUID CRYSTAL DISPLAY APPARATUS INCLUDING SCANNING CIRCUIT HAVING BIDIRECTIONAL SHIFT REGISTER STAGES

(75) Inventors: Katsutoshi Saito, Mobara (JP); Hideo Sato, Hitachi (JP); Iwao Takemoto, Mobara (JP); Katsumi Matsumoto, Mobara (JP)

(73) Assignees: Hitachi, Ltd., Tokyo (JP); Hitachi Device Engineering Co., Ltd., Mobara (JP)

( * ) Notice: Subject to any disclaimer, the term of this patent is extended or adjusted under 35 U.S.C. 154(b) by 0 days.

(21) Appl. No.: 09/653,548

(22) Filed: Aug. 31, 2000

Related U.S. Application Data

(63) Continuation of application No. 09/188,110, filed on Nov. 9, 1998, now Pat. No. 6,232,939.

(30) Foreign Application Priority Data

Nov. 10, 1997 (JP) ..... 9-306830

(51) Int. Cl.[7] ..... G09G 3/36
(52) U.S. Cl. ..... 345/98; 345/100
(58) Field of Search ..... 345/93, 100, 197, 345/98

(56) References Cited

U.S. PATENT DOCUMENTS

| | | | | |
|---|---|---|---|---|
| 5,179,371 A | | 1/1993 | Yamazaki | 340/784 |
| 5,223,824 A | | 6/1993 | Takeda et al. | 340/813 |
| 5,282,234 A | * | 1/1994 | Murayama et al. | 345/87 |
| 5,717,351 A | * | 2/1998 | Katsutani | 327/108 |
| 5,781,171 A | | 7/1998 | Kihara et al. | 345/93 |
| 5,815,129 A | | 9/1998 | Jung | 345/93 |
| 5,889,504 A | | 3/1999 | Kihara et al. | 345/100 |
| 5,894,296 A | * | 4/1999 | Maekawa | 345/98 |
| 5,956,009 A | | 9/1999 | Zhang et al. | 345/93 |
| 5,969,713 A | | 10/1999 | Tomizawa et al. | 345/198 |
| 5,990,857 A | | 11/1999 | Kubota et al. | 345/98 |
| 6,020,871 A | * | 2/2000 | Asada | 345/100 |
| 6,023,260 A | | 2/2000 | Higashi | 345/100 |
| 6,232,939 B1 | * | 5/2001 | Saito et al. | 345/93 |

FOREIGN PATENT DOCUMENTS

| | | | |
|---|---|---|---|
| JP | 07020826 | * | 1/1995 |
| JP | 11176186 | * | 7/1999 |
| JP | 2000338937 | * | 1/2000 |

OTHER PUBLICATIONS

Y. Takafuji et al., A 1.9–in. 1.5–MPixel Driver Fully–Integrated Poly–Si TFT–LCD for HDTV Projection, *SID 93 Digest*, 1993, pp. 383–386, The Society for Information Display.

* cited by examiner

*Primary Examiner*—Richard Hjerpe
*Assistant Examiner*—Kevin M. Nguyen
(74) *Attorney, Agent, or Firm*—Antonelli, Terry, Stout & Kraus, LLP

(57) ABSTRACT

A liquid crystal display apparatus has horizontal and vertical scanning circuits for scanning an array of pixels. An image signal applied to an image signal supply circuit in the form of series of pixel signals is transferred to pixels in the array of pixels designated by the horizontal and vertical scanning circuits. Each of the horizontal and vertical scanning circuits have a series connection of bidirectional shift register stages and are capable of bidirectional scanning. Each of the bidirectional shift register stages includes a pair of latches connected in tandem and is capable of providing an intermediate output and a shift register stage output. The pair of latches of each of the bidirectional shift register stages except those located at both ends of the series connection have respective intermediate and bidirectional shift register stage outputs contributing to designation of pixels to which pixel signals are to be supplied, while the pair of latches of the shift register stages located at each end of the series connection have their bidirectional shift register stage outputs contributing to such designation of pixels and their intermediate output terminals not contributing to such designation of pixels.

8 Claims, 18 Drawing Sheets

SIMULTANEOUS DRIVING OF
(2n-1)TH AND (2n)TH LINES

SIMULTANEOUS DRIVING OF
(2n)TH AND (2n+1)TH LINES

EVEN-NUMBERED LINE
SKIPPED DRIVING

ODD-NUMBERED LINE
SKIPPED DRIVING

LIQUID CRYSTAL DISPLAY APPARATUS INCLUDING SCANNING CIRCUIT HAVING BIDIRECTIONAL SHIFT REGISTER STAGES

CROSS-REFERENCE TO RELATED APPLICATION

This application is a continuation of application Ser. No. 09/188,110 filed on Nov. 9, 1998, now U.S. Pat. No. 6,232,939, the contents of which are incorporated herein by reference in their entirety.

The present invention relates to a liquid crystal display apparatus, and more particularly to a technology which is effective when applied to a liquid crystal display apparatus in which a display pixel of an active matrix-driven type and a driving circuit therefor are formed on a glass substrate or a silicon chip.

A liquid crystal panel is being widely used as a television set, a monitor of information devices such as a personal computer, and a display apparatus for the other various kinds of display apparatuses.

This kind of liquid crystal panel is constituted as follows: A driving electrode, which serves as an electrode of a switching element for selecting a pixel, is formed on one substrate, and a common electrode is formed on the other substrate. Then, sides of both the electrodes are opposed and laminated to each other with a gap, and a liquid crystal layer is disposed in the gap, to thereby constituting the panel.

In a structure in which an amorphous silicon thin film is employed for a channel layer of a FET switching element, there will be a limit to the characteristics as a transistor. If such structure is used to constitute a driving circuit, resulting characteristics will be insufficient, thus making it necessary to provide a peripheral driving circuit outside the glass substrate.

Meanwhile, the following type of display apparatus has been developed: A thin film transistor (hereinafter, referred to as TFT) is formed using a poly-silicon film, so that a driving circuit, as well as switching elements for selecting display pixels, is formed on one and the same glass substrate. Incidentally, concerning the TFT elements formed using the polysilicon film, a product manufactured therefrom, about which the number of pixels is about one hundred thousand and diagonal length of a display area is 0.7 inches, is used as a color finder of a small-sized video camera.

Moreover, concerning the above-described TFT display apparatus in which the poly-silicon film is used, the utilization thereof has been developed as a display source of a projector or as a panel for a head mount (glasses-shaped) display designed for a virtual reality.

Furthermore, a polymer dispersion type liquid crystal (hereinafter, referred to as PDLC) display element has been developed in the following way: A common electrode is formed on a transparent substrate and a driving electrode is formed on a silicon substrate. Then, a liquid crystal layer of a macromolecule dispersion type is sandwiched in a lamination gap between both the electrodes, thus forming the PDLC.

In connection with the above-described methods of utilizing the TFT display apparatus in which the poly-silicon film is used or a display apparatus in which the PDLC is used, there is a liquid crystal projector optical system based on a three-color plates system. The three-plates system is a system employing a display apparatus which allows an image to be formed for each of colors of red, green and blue.

FIG. 1 shows a schematic diagram of the liquid crystal projector optical system based on the three-plates system. A light launched from a light source 850, which comprises, for example, a metal halide lamp and a parabolic surface mirror, reaches a dichroic mirror 851. Here, the dichroic mirror 851 has a function of allowing a light in a specific wavelength range to be reflected or to pass through. Thus, only a blue light is reflected with its direction changed by 90 degrees, and the other lights are permitted to pass through. The other lights which have passed through, i.e. transmitting lights, are launched into a dichroic mirror 852. Only a green light is reflected there, and a transmitting light turns out to be a red one. In this way, the lights resolved in the order of blue, green and red are each launched into specifically designed liquid crystal panels 853, 854 and 855. On each of the liquid crystal panels 853, 854 and 855, an image corresponding to each of the colors has been reproduced. Then, each of the incoming lights, after being modulated for each color, is superimposed.

At a dichroic mirror 856, the green light is reflected. The reflected green light is superimposed with the blue light which has passed through the liquid crystal panel 853. The superimposed light is further superimposed with the red light reflected by a dichroic mirror 857. The superimposed light is projected onto a screen by a projection lens.

In the optical system as described above, first, the blue transmitting light from the liquid crystal panel 853 has never been reflected even one time. Accordingly, the blue transmitting light is superimposed in such a state that the pattern on the liquid crystal panel remains unchanged, and then is launched into the projection lens. Then, the red transmitting light from the liquid crystal panel 855 undergoes a direction conversion by 90 degrees two times at a reflection mirror 858 and at the dichroic mirror 857. Consequently, as is the case with the blue transmitting light, the red transmitting light is superimposed in such a state that the pattern on the liquid crystal panel remains unchanged, and then is launched into the projection lens.

Moreover, the green transmitting light from the liquid crystal panel 854 undergoes a direction conversion by 90 degrees only one time at the dichroic mirror 856. Accordingly, the green transmitting light is launched into the projection lens with the pattern on the liquid crystal panel inverted from top to bottom or from right to left. On account of this, in order to make the images coincide with each other, it becomes necessary for the green liquid crystal panel 854 to display an image which is, in advance, inverted from top to bottom or from right to left. Incidentally, reference numeral 859 designates a reflection mirror.

In the green liquid crystal panel 854, in order to invert an image thereon from right to left or from top to bottom, the following methods are generally employed: An inversion driving circuit is newly provided, the green liquid crystal panel 854 is specially manufactured so that, in order to display the inverted image, it can scan in a direction opposite to that of the red and the blue liquid crystal panels 853, 855, image data is stored once in a memory and is then read out so that the image is inverted, and so on.

Namely, in the liquid crystal projector based on the three primary colors-separating system, only one color component of the color images differs in the number of times of inversion from the other color components. This situation causes the component through a usual liquid crystal panel to be inverted from right to left or from top to bottom, and thus it turns out that the usual liquid crystal panel outputs the inverted image. Accordingly, a specific structure is added to the usual liquid crystal panel so that it can output an inverted image independently. An example of such a liquid crystal panel as outputting the inverted image is indicated on pages 383–386 of SID 93 DIGEST (1993).

SUMMARY OF THE INVENTION

According to one aspect of the present invention, in a liquid crystal display apparatus having horizontal and vertical scanning circuits capable of bidirectionally scanning an array of pixels and an image signal supply circuit to which an image signal is applied in the form of series of pixel signals, the horizontal and vertical scanning circuits have a series connection of bidirectional shift register stages. Each of the bidirectional shift register stages includes a pair of latches connected in tandem and is capable of providing an intermediate output and a shift register stage output. The pair of latches of each of the bidirectional shift register stages except those located at both ends of the series connection have respective intermediate and bidirectional shift register stage outputs contributing to designation of pixels to which pixel signals are to be supplied, while the pair of latches of the shift register stages located at each end of the series connection have their bidirectional shift register stage outputs contributing to such designation of pixels and their intermediate outputs not contributing to such designation of pixels.

According to another aspect of the present invention, at least one of the horizontal scanning circuit and vertical scanning circuit of the liquid crystal display apparatus further includes a reset circuit.

According to another aspect of the present invention, each of the horizontal scanning circuit and vertical scanning circuit of the liquid crystal display apparatus operate with clock signals, and has a structure such that a shift operation of each of the shift register stages is responsive to the duty ratio of its associated clock signal.

DETAILED DESCRIPTION OF THE INVENTION

The detailed description will be given below concerning embodiments of the present invention, referring to the accompanying drawings.

Figure 2A:
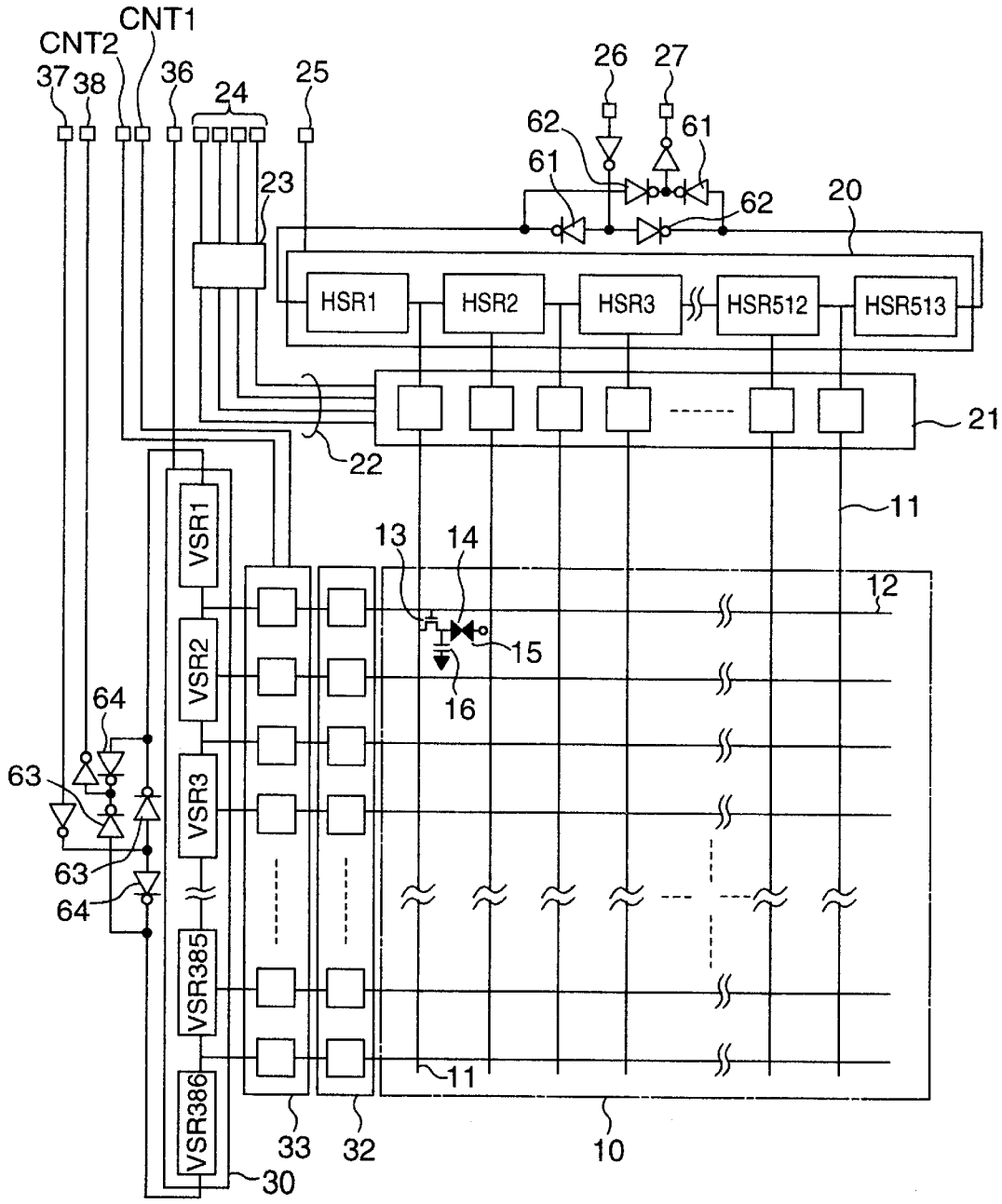
FIG. 2*a* is a schematic block diagram for showing a liquid crystal display apparatus according to an embodiment of the present invention.

FIG. 2*a* shows an embodiment of a liquid crystal display apparatus according to the present invention. FIG. 2*a* shows a block for each function formed on a substrate. Reference numeral 10 denotes an array of liquid crystal pixels or an image display area. In the image display area 10, a plurality of image signal lines 11, which extend in a vertical direction in FIG. 2*a* and are arranged in parallel in a horizontal direction, are provided. Moreover, a plurality of scan signal lines 12, which extend in a horizontal direction in such a manner as to be substantially perpendicular to the image signal lines and are arranged in parallel in a vertical direction, are provided. A switching element 13 is provided in proximity to a point at which an image signal line 11 intersects a scan signal line 12. Operation of the switching element 13 by the image signal line 11 and the scan signal line 12 allows an image signal to be written in a pixel electrode 14. An opposite electrode 15 is provided in such a manner that it is opposed to the pixel electrode 14. An electric potential difference between the pixel electrode 14 and the opposite electrode 15 makes it possible to drive the liquid crystal, thus displaying an image. Also, in order to store the image signal in the pixel electrode 14 for a fixed time period, the pixel electrode 14 is provided with a storage capacitor 16. Incidentally, in FIG. 2*a,* the pixel electrode 14, the opposite electrode 15 and the storage capacitor 16 are expressed by equivalent circuits. Also, in order to make the drawing easier to understand through the simplification, the components related with only a single pixel are illustrated in the image display area 10. Actually, however, a plurality of pixels are located in a matrix-like form so as to constitute the array.

In general, writing an image signal is started from the top left in FIG. 2*a*. Image signals, in a direction from left to right and in sequence, are written into the first line of the pixels located in a matrix-like form, thus finishing the writing into the first line. The embodiment in FIG. 2*a* deals with and indicates an example with 1025 pixels in a transverse direction and 769 pixels in a longitudinal direction. When writing into the 1025th pixel in the first line is over, the image signals, in the direction from left to right and in sequence, are again written into the pixel electrodes 14 in the second line. Hereinafter, in much the same way, the writing is performed until the last 769th line, thereby displaying the image. On account of this, in order to display an image inverted from right to left, it becomes necessary to write, in a direction from right to left, the image signals into the pixels located in a matrix-like form. Additionally, in a method in which, after a single line of data is stored once in a memory such as a latch circuit, a single line of image signals are outputted in accordance with the data, it turns out that the data is also written, in the direction from left to right and in sequence, into the memory such as the latch circuit.

Figure 3:
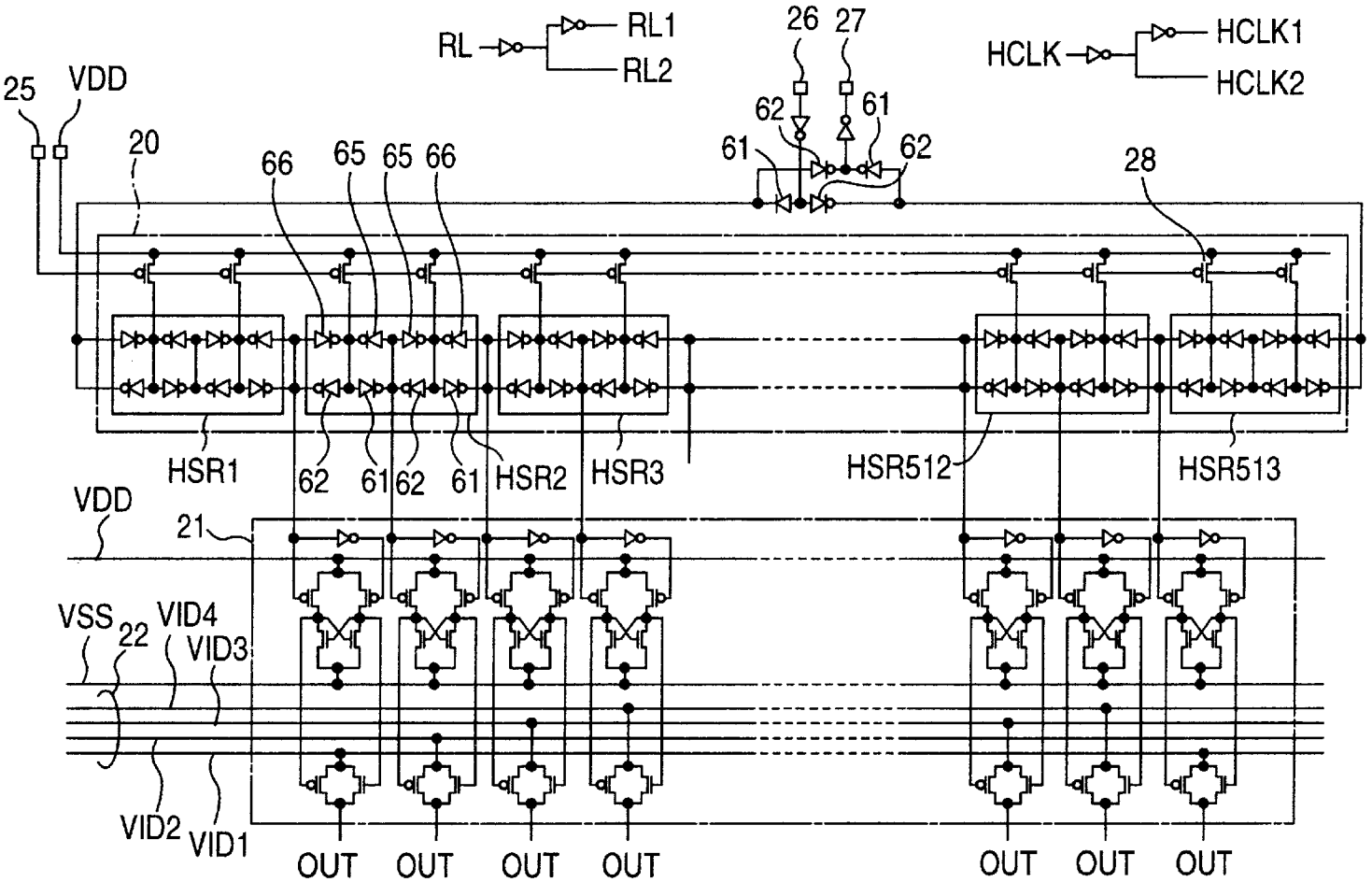
FIG. 3 is a schematic circuit diagram of a horizontal scanning circuit and an image signal supply circuit, which are applicable to the apparatus in FIG. 2*a;*

FIG. 3 shows a circuit structure of a horizontal scanning circuit comprising a horizontal shift register 20 and an image signal supply circuit 21. Reference symbols HSR1, HSR2, . . . , HSR513, which denote horizontal scanning bidirectional shift register stages connected in series, make it possible to shift a signal bidirectionally, i.e. in right and left directions. A bidirectional shift register HSR comprises clocked inverters 61, 62, 65 and 66. Incidentally, the horizontal scanning bidirectional shift register stages (hereinafter, referred to as simply HSR stages) will be described in detail later. The image signal supply circuit 21 receives an output signal from the horizontal shift register 20, and outputs pixel signals, which are supplied from pixel signal input lines 22, to the image signal lines 11. Incidentally, the circuit 21 also performs a level shift which converts a signal level of the output signal from the horizontal shift register 20 into a signal level at which the image signals are allowed to be driven.

A signal switching circuit 23 in FIG. 2*a* rearranges, if required, a plurality of series of pixel signals inputted in parallel into a plurality of image signal input terminals 24, and supplies the rearranged series of pixel signals to the pixel signal input lines 22. In the embodiment shown in FIGS. 2*a* and 3, the series of pixel signals are supplied in parallel by means of four signal lines. For example, in FIG. 2*a,* the image signal input terminals 24, from the left and in turn, correspond respectively to the first, the second, . . . , and the fourth pixels located horizontally. On account of this, when inverting a scanning direction, it becomes necessary to alter turn of the pixel signals supplied to the image signal input terminals 24. Here, however, with the use of the signal switching circuit 23, by altering turn of the pixel signals supplied to the pixel signal input lines 22, it becomes unnecessary to provide, outside the glass substrate (silicon chip), a circuit for altering the turn of the pixel signals.

Figure 2B:
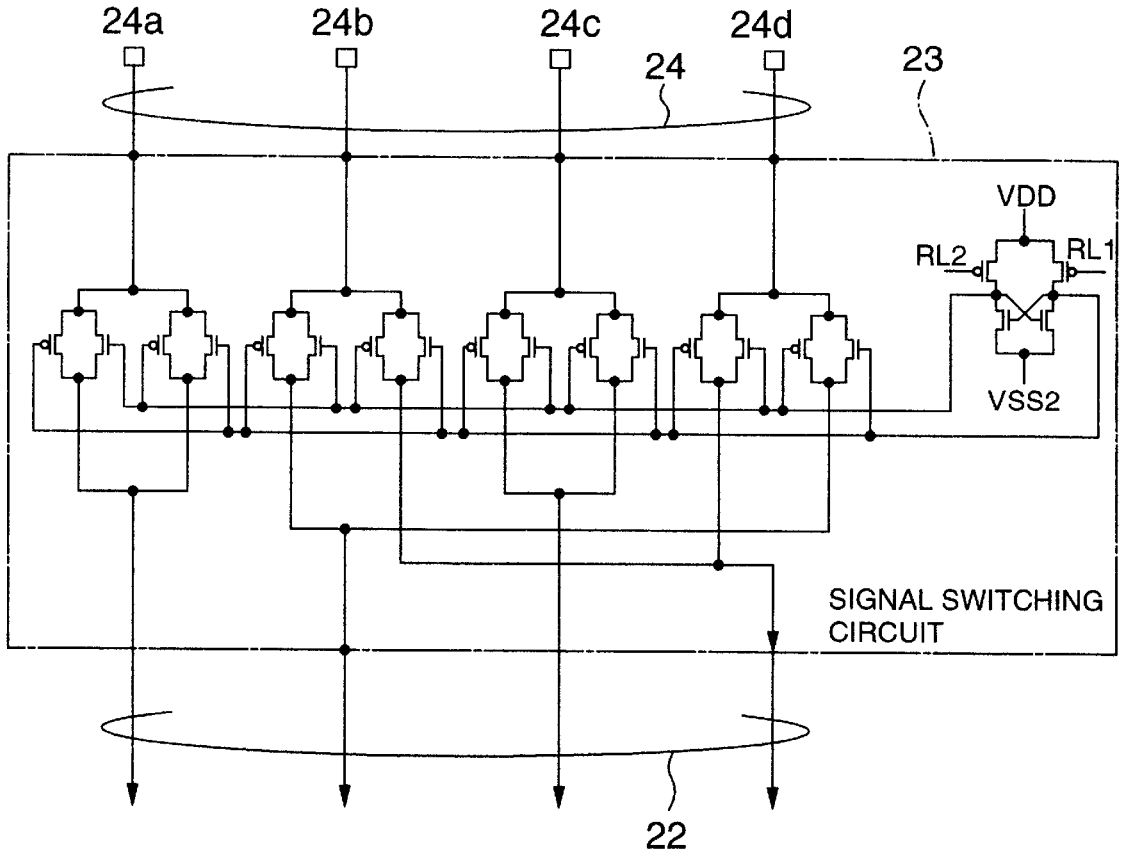
FIG. 2*b* is a schematic circuit diagram of a signal switching circuit applicable to the apparatus in FIG. 2*a;*

FIG. 2*b* shows an example of a signal switching circuit. In the example shown in the Figure, pixel signals, in time sequence, are inputted into four image signal input terminals 24*a,* 24*b,* 24*c* and 24*d,* respectively. The four pixel signal input lines 22 to be connected with the respective image signal lines 11 are determined by the image signal supply circuit 21, as can be understood also from FIG. 3. Here, it is noted that while the horizontal scanning circuit 20 is symmetrical as viewed in the lateral or horizontal direction, the image signal supply circuit 21 is not. More specifically, referring to FIG. 3, the circuit 21, when viewed from left to right, will receive the pixel signals in the order of VID1-VID2-VID3-VID4 from the lines 22, and when viewed from right to left, will receive the pixel signals in the order of VID1-VID4-VID3-VID2 from the lines 22. Thus, when the scanning direction is reversed, pixel signals VID2 and VID4 will not be in good order, which will make it necessary to exchange the order of supply of the pixel signals to the image signal supply circuit 21. Accordingly, the circuit 23 shown in FIG. 3 serves to exchange, among the four pixel signals, a pixel signal inputted into the terminal 24*b* for a pixel signal inputted into the terminal 24*d*. Here, the terminals 24*b* and 24*d* are the ones which are the second and the fourth from the left of the illustrated four image signal input terminals. In FIG. 2*b,* for each of the first and third terminals 24*a* and 24*c* for which no signal switching is required, a circuit similar to the circuit provided for the terminals 24*b* and 24*d* is provided, prohibiting the switching operation therebetween. This aims at preventing occurrence of variations in the phase and/or the amplitude of the pixel signals inputted into the image signal input terminals 24*b* and 24*d* which are the second and the fourth from the left.

In FIGS. 2*a* and 3, reference numeral 25 denotes a horizontal scanning reset signal input terminal. Numeral 26 denotes a horizontal scanning start signal input terminal. The clocked inverter 61 supplies a start signal, which corresponds to a scanning performed in a direction from left to right in FIG. 2*a,* to the horizontal shift register 20. When the scanning is performed from right to left, the clocked inverter 62 supplies a start signal concerned therewith to the horizontal shift register 20. Numeral 27 denotes a horizontal scanning end signal output terminal.

In FIG. 3, reference symbol RL denotes a horizontal scanning direction setting signal line, symbol RL1 denotes a first horizontal direction setting line, and symbol RL2 denotes a second horizontal direction setting line. They carry signals which determine a scanning direction by means of the horizontal scanning bidirectional shift register stages. A signal supplied to the signal line RL may be a binary signal having two levels corresponding to high and low levels of the signal supplied to the horizontal clock signal line HCLK. The first horizontal direction setting line RL1 extracts a signal which the inverters obtain by inverting two times a signal from the horizontal scanning direction setting signal line RL. The second horizontal direction setting line RL2 extracts a signal which an inverter obtains by inverting one time a signal from the horizontal scanning direction setting signal line RL. Accordingly, concerning a signal transferred by the first horizontal direction setting line RL1 and a signal transferred by the second horizontal direction setting line RL2, one of the signals coincides with a signal obtained by inverting the other signal. Also, reference symbol HCLK denotes a horizontal clock signal line, and a signal supplied to the signal line HCLK may be a clock signal generated by an external clock source and having an amplitude identical with a power source voltage VDD for elements of the circuit 20 and levels identical with those of a signal supplied thereto. Symbol HCLK1 denotes a first horizontal clock signal line, and symbol HCLK2 denotes a second horizontal clock signal line. The first horizontal clock signal line HCLK1 extracts a signal obtained by inverting two times a signal from the signal line HCLK. The second horizontal clock signal line HCLK2 extracts a signal obtained by inverting one time a signal from the signal line HCLK.

Figure 4:
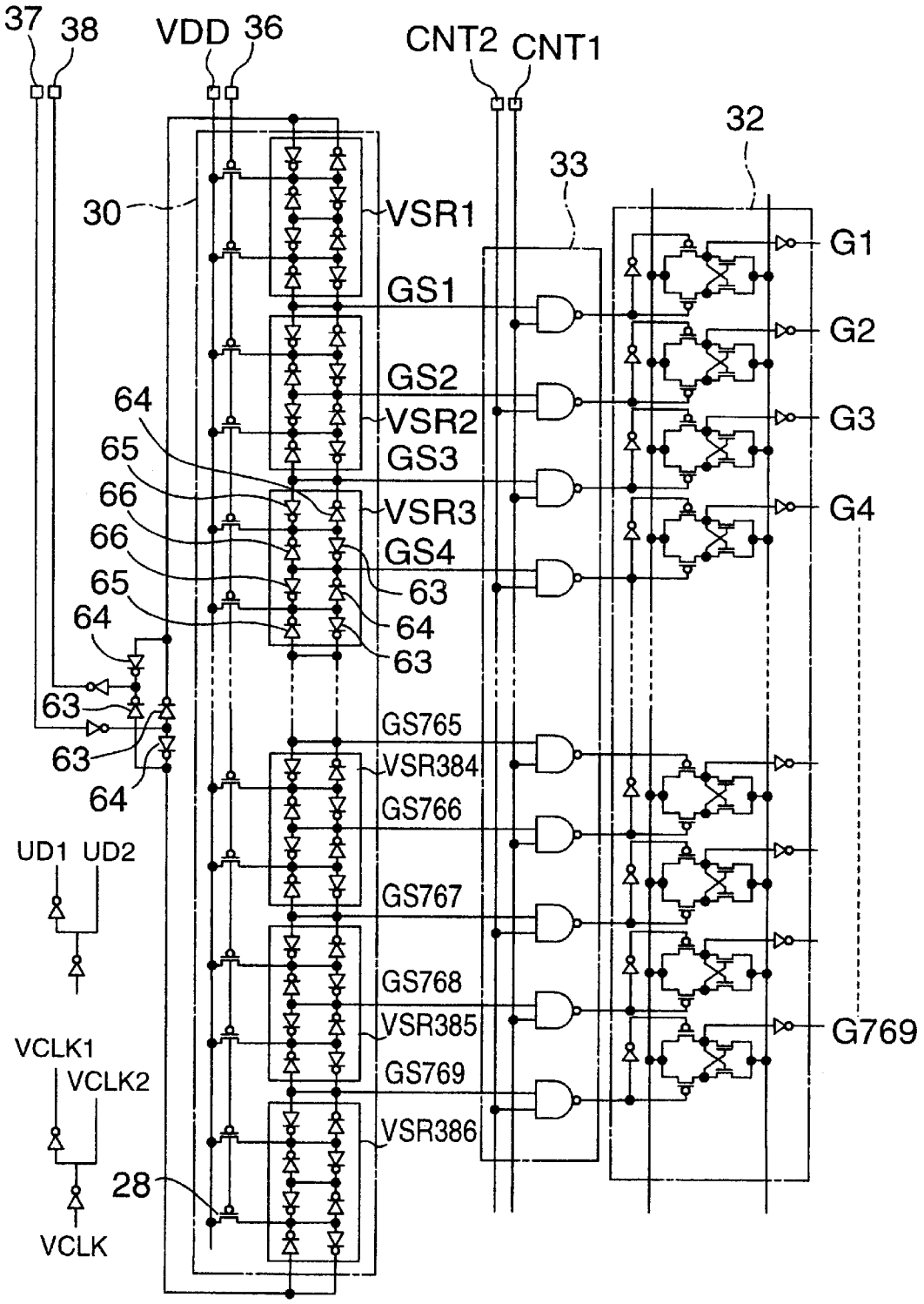
FIG. 4 is a schematic circuit diagram of a vertical scanning circuit, a vertical scanning control circuit and a vertical outputting circuit, which are applicable to the apparatus in FIG. 2*a;*

FIG. 4 shows a circuit structure of a vertical scanning circuit comprising a vertical shift register 30, a vertical scanning control circuit 33 and a vertical outputting circuit 32. As is the case with the horizontal shift register 20, the vertical shift register 30 also makes it possible to shift a signal bidirectionally. When displaying an image inverted from top to bottom, a scanning signal is outputted in an upward direction from below. Reference symbols VSR1, VSR2, . . . , VSR385 denote vertical scanning bidirectional shift register stages connected in series, numeral 32 denotes the vertical outputting circuit, and numeral 33 denotes the vertical scanning control circuit. The vertical scanning control circuit 33 controls a vertical scanning in accordance with control signals from control signal input terminals CNT1, CNT2 and output signals of the vertical scanning circuit 30. Reference numeral 36 denotes a vertical scanning reset signal input terminal, numeral 37 denotes a vertical scanning start signal input terminal, and numeral 38 denotes a vertical scanning end signal output terminal. A vertical scanning bidirectional shift register stage VSR (hereinafter, referred to as simply VSR stage), as described later, comprises clocked inverters 63, 64, 65 and 66.

In FIG. 4, reference symbol UD denotes a vertical scanning direction setting line, symbol UD1 denotes a first vertical direction setting line, and symbol UD2 denotes a second vertical direction setting line. They carry signals which determine a scanning direction by means of the vertical scanning bidirectional shift register stages. A signal supplied to the signal line UD may be a binary signal having two levels corresponding to high and low levels of the signal supplied to the vertical clock signal line VCLK. In FIG. 4, the first vertical direction setting line UD1 extracts a signal which the inverters obtain by inverting two times a signal from the vertical scanning direction setting line UD. The second vertical direction setting line UD2 extracts a signal which an inverter obtains by inverting one time a signal from the vertical scanning direction setting line UD. Accordingly, concerning a signal transferred by the first vertical direction setting line UD1 and a signal transferred by the second vertical direction setting line UD2, one of the signals coincides with a signal obtained by inverting the other signal. Also, reference symbol VCLK denotes a vertical clock signal line, symbol VCLK1 denotes a first vertical clock signal line, and symbol VCLK2 denotes a second vertical clock signal line. A signal supplied to the signal line VCLK may be a clock signal generated by an external clock source and having an amplitude identical with a power source voltage VDD for elements of the circuit 30 and levels identical with those of a signal supplied thereto.

FIGS. 5*a* to 5*d* show circuit structural diagrams for explaining the horizontal scanning bidirectional shift register stages (HSR stages) constituting the horizontal shift register 20 and the vertical scanning bidirectional shift register stages (VSR stages) constituting the vertical shift register 30. Also, FIGS. 6*a* to 6*f* show circuit diagrams for explaining the clocked inverters 61, 62, 63, 64, 65 and 66, which are used in a HSR stage in the horizontal shift register 20 and/or in a VSR stage in the vertical shift register 30.

First, using FIGS. 5*a*, 5*b*, the description will be given concerning the clocked inverters 61, 62, used in the horizontal scanning bidirectional shift register stage (HSR stage).

In FIG. 3, the first horizontal direction setting line RL1 is at H level when a scanning is performed from left to right, and the second horizontal direction setting line RL2 is at H level when a scanning is performed from right to left. Although, in order to make FIGS. 2*a*, 3 and 5*a* look clear and legible, connecting lines are omitted in the Figures, both the first horizontal direction setting line RL1 and the second horizontal direction setting line RL2 are connected to the clocked inverters 61, 62 which the horizontal scanning bidirectional shift register stages (HSR1, HSR2, . . . , HSR513) include.

Figure 6A:
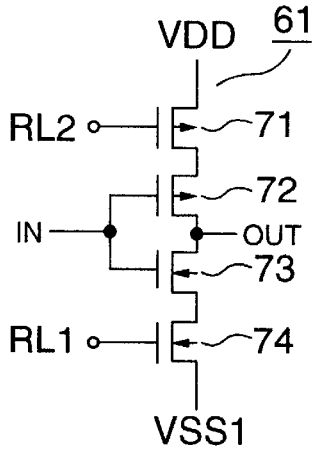
FIGS. 6*a* to 6*f* are schematic circuit diagrams of a clocked inverter applicable for constituting the bidirectional shift register stages in FIGS. 5*a* and 5*b;*

The clocked inverter 61, as shown in FIG. 6*a*, comprises P type transistors 71, 72 and N type transistors 73, 74. The P type transistor 71 is connected to the second horizontal direction setting line RL2, and the N type transistor 74 is connected to the first horizontal direction setting line RL1. On account of this, the clocked inverter 61 operates as an inverter when the first horizontal direction setting line RL1 is at H level and the second horizontal direction setting line RL2 is at L level, and has a high impedance when the second horizontal direction setting line RL2 is at H level and the first horizontal direction setting line RL1 is at L level.

Figure 6B:
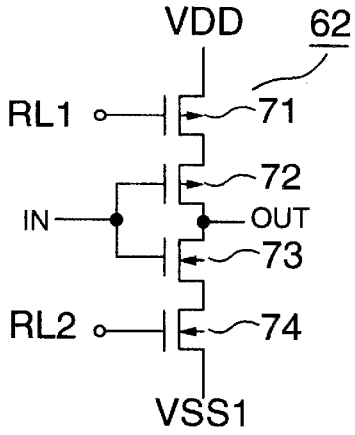

Conversely, in the clocked inverter 62, as shown in FIG. 6*b*, the P type transistor 71 is connected to the first horizontal direction setting line RL1, and the N type transistor 74 is connected to the second horizontal direction setting line RL2. On account of this, the clocked inverter 62 operates as an inverter when the second horizontal direction setting line RL2 is at H level, and has a high impedance when the first horizontal direction setting line RL1 is at H level.

Figure 5A:
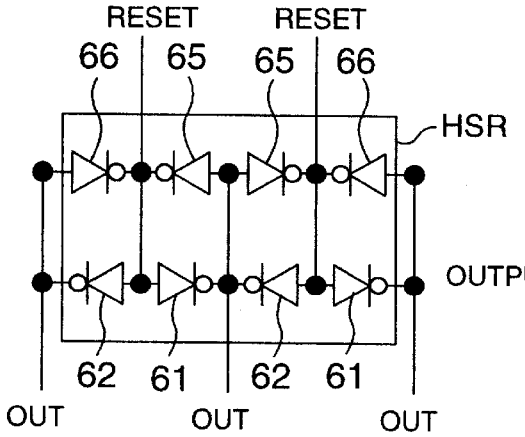
FIGS. 5*a* to 5*d* are schematic circuit diagrams and operation illustrating diagrams of bidirectional shift register stages applicable for constituting the horizontal scanning circuit in FIG. 3 and the vertical scanning circuit in FIG. 4.
Figure 5C:
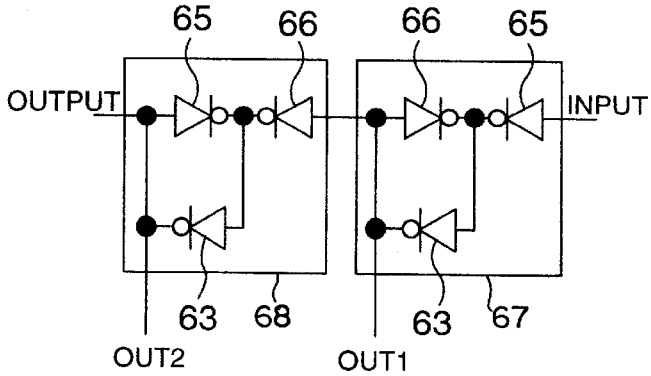

Next, using FIGS. 6*c*, 6*d*, the description will be given concerning the clocked inverters 63, 64 used in the vertical scanning bidirectional shift register stage (VSR stage) shown in FIGS. 5*b*, 5*c* and 5*d*. Moreover, the description will be given concerning an operation of the VSR stage which allows a scanning direction to be altered based on values of the vertical scanning direction setting lines UD1, UD2 determining the scanning direction.

In FIG. 4, the first vertical direction setting line UD1 is at H level when a scanning is performed from top to bottom, and the second vertical direction setting line UD2 is at H level when a scanning is performed from bottom to top. Although, in order to make FIGS. 2*a*, 4 and 5*b* to 5*d* look clear and legible, connecting lines are omitted in the Figures, both the first vertical direction setting line UD1 and the second vertical direction setting line UD2 are connected to the clocked inverters 63, 64 which the VSR stages (VSR1, VSR2, . . . , VSR386) include.

Figure 6C:
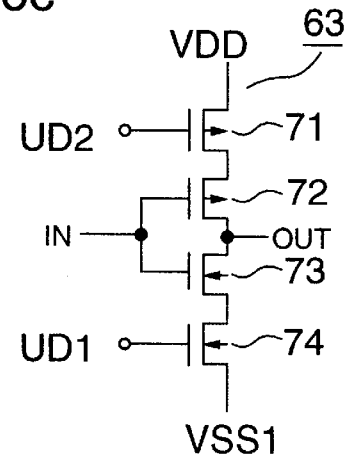

The clocked inverter 63, as shown in FIG. 6*c*, comprises P type transistors 71, 72 and N type transistors 73, 74. The N type transistor 74 is connected to the first vertical direction setting line UD1, and the P type transistor 71 is connected to the second vertical direction setting line UD2. Also, as shown in FIG. 6*d*, in the clocked inverter 64, the N type transistor 74 is connected to the second vertical direction setting line UD2, and the P type transistor 71 is connected to the first vertical direction setting line UD1. On account of this, the clocked inverter 63 operates as an inverter when the first vertical direction setting line UD1 is at H level and the second vertical direction setting line UD2 is at L level, and has a high impedance when the second vertical direction setting line UD2 is at H level and the first vertical direction setting line UD1 is at L level. It is obvious that the clocked inverter 64, for levels of the first and second vertical direction setting lines UD1, UD2, performs operations opposite to those of the clocked inverter 63.

Figure 5B:
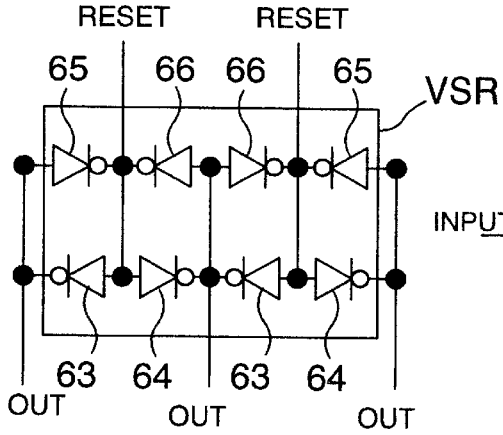
Figure 5D:
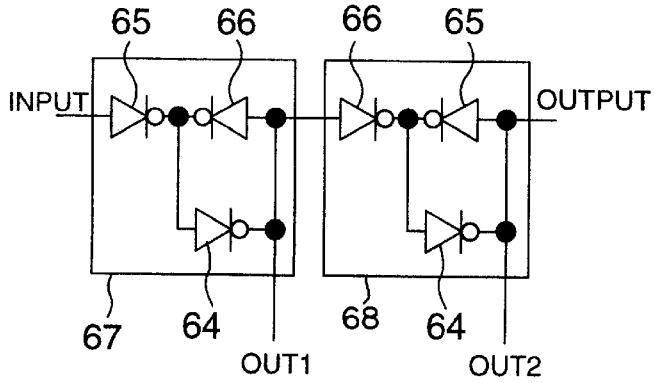
Figure 6D:
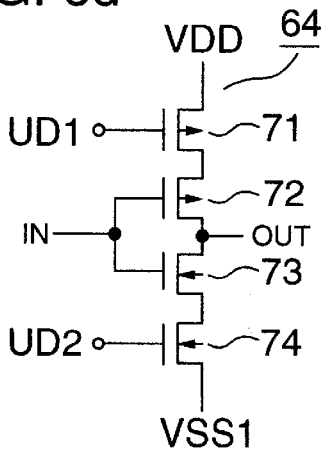
Figure 6E:
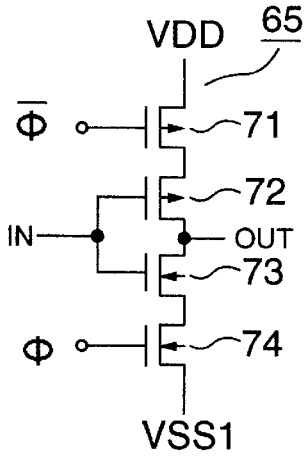

In the VSR stage shown in FIG. 5*b*, when the first vertical direction setting line UD1 (FIG. 6*c*) is at H level, the clocked inverter 63 operates as an inverter and the clocked inverter 64 has a high impedance. Consequently, in this case, the VSR stage becomes an equivalent circuit as illustrated in FIG. 5*c*. When the second vertical direction setting line UD2 is at H level, the clocked inverter 64 operates as an inverter and the clocked inverter 63 has a high impedance. Consequently, in this case, the VSR stage becomes an equivalent circuit as illustrated in FIG. 5*d*. In this way, in the VSR stage shown in FIG. 5*b*, values of the first vertical direction setting line UD1 and the second vertical direction setting line UD2 make it possible to determine a scanning direction (shift direction) by the shift register stage. Similarly, in the horizontal scanning bidirectional shift register stage (HSR stage) shown in FIG. 5*a*, too, values of the first horizontal direction setting line RL1 and the second horizontal direction setting line RL2 make it possible to determine a scanning direction (shift direction) by the shift register stage.

Next, using FIG. 5*c*, the description will be given concerning an operation of the VSR stage. The clocked inverter 65 has a circuit structure shown in FIG. 6*e*. Thus, as is indicated in Table 1, when a clock Φ is at H level and a clock Φ bar is at L level, the clocked inverter 65 inverts and outputs an input, and when the clock Φ is at L level and the clock Φ bar is at H level, the clocked inverter 65 has a high impedance.

Figure 6F:
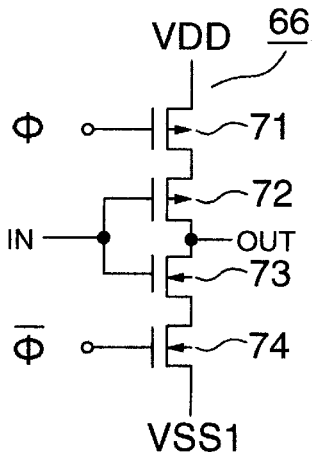

Also, the clocked inverter 66 has a circuit structure shown in FIG. 6*f*. Thus, when a clock Φ bar is at H level and a clock Φ is at L level, the clocked inverter 66 inverts and outputs an input, and when the clock Φ bar is at L level and the clock Φ is at H level, the clocked inverter 66 has a high impedance.

TABLE 1

| INPUT | Φ | Φ | CLOCKED INVERTER 65 | CLOCKED INVERTER 66 |
|---|---|---|---|---|
| H | H | L | L | HIGH IMPEDANCE |
| H | L | H | HIGH IMPEDANCE | L |
| H | L | L | HIGH IMPEDANCE | HIGH IMPEDANCE |
| L | H | L | H | HIGH IMPEDANCE |
| L | L | H | HIGH IMPEDANCE | H |
| L | H | H | HIGH IMPEDANCE | HIGH IMPEDANCE |

In FIGS. 2*a*, 3 and 4, connecting lines for the clock signal lines are omitted. Actually, however, the clocked inverters 65, 66 in the HSR stages in FIGS. 2*a*, 3 are connected to the clock signal lines HCLK1, HCLK2, and the clocked inverters 65, 66 in the VSR stages in FIGS. 2*a*, 4 are connected to the clock signal lines VCLK1, VCLK2. In the following description, the description will be given using arbitrary clocks Φ, Φ bar.

Referring to FIG. 5*c*, in a latch circuit which exists in a preceding stage (the first stage) and is denoted by reference numeral 67, an output of the clocked inverter 65 is connected to an input of the inverter 63, and an output of this inverter 63 is connected to an input of the clocked inverter 66. On account of this, a signal inputted into the clocked inverter 65 when the clock signal Φ is at H level is inverted, and is then inputted into the inverter 63. Next, when the clock signal Φ bar changes to be at H level, the clocked inverter 65 has a high impedance but the clocked inverter 66 operates as an inverter. This causes the inverter 63 and the clocked inverter 66 to latch the output of the clocked inverter 65, thus allowing the inverter 63 to generate an inversion signal of the output signal of the clocked inverter 65 (an intermediate output of the shift register stage VSR).

Also, in a latch circuit which exists in a subsequent stage (the second stage) and is denoted by reference numeral 68, an output of the clocked inverter 66 is connected to an input of the inverter 63, and an output of this inverter 63 is connected to an input of the clocked inverter 65. On account of this, a signal, which is inputted into the clocked inverter 66 from the latch circuit 67 in the preceding stage when the clock signal Φ bar is at H level (namely, when the clock signal Φ is at L level), is inverted, is then inputted into the inverter 63. Next, when the clock signal Φ changes to be at H level, the clocked inverter 66 has a high impedance but the clocked inverter 65 operates as an inverter. This causes the inverter 63 and the clocked inverter 65 to latch the output of the clocked inverter 66, thus allowing the inverter 63 to generate an inversion signal of the output of the clocked inverter 66 (a shift register stage output of the shift register stage VSR). As is seen from the above explanation, by referring to FIGS. 5*c*, 5*d*, the latch circuits 67, 68 are mutually connected in tandem.

Figure 7:
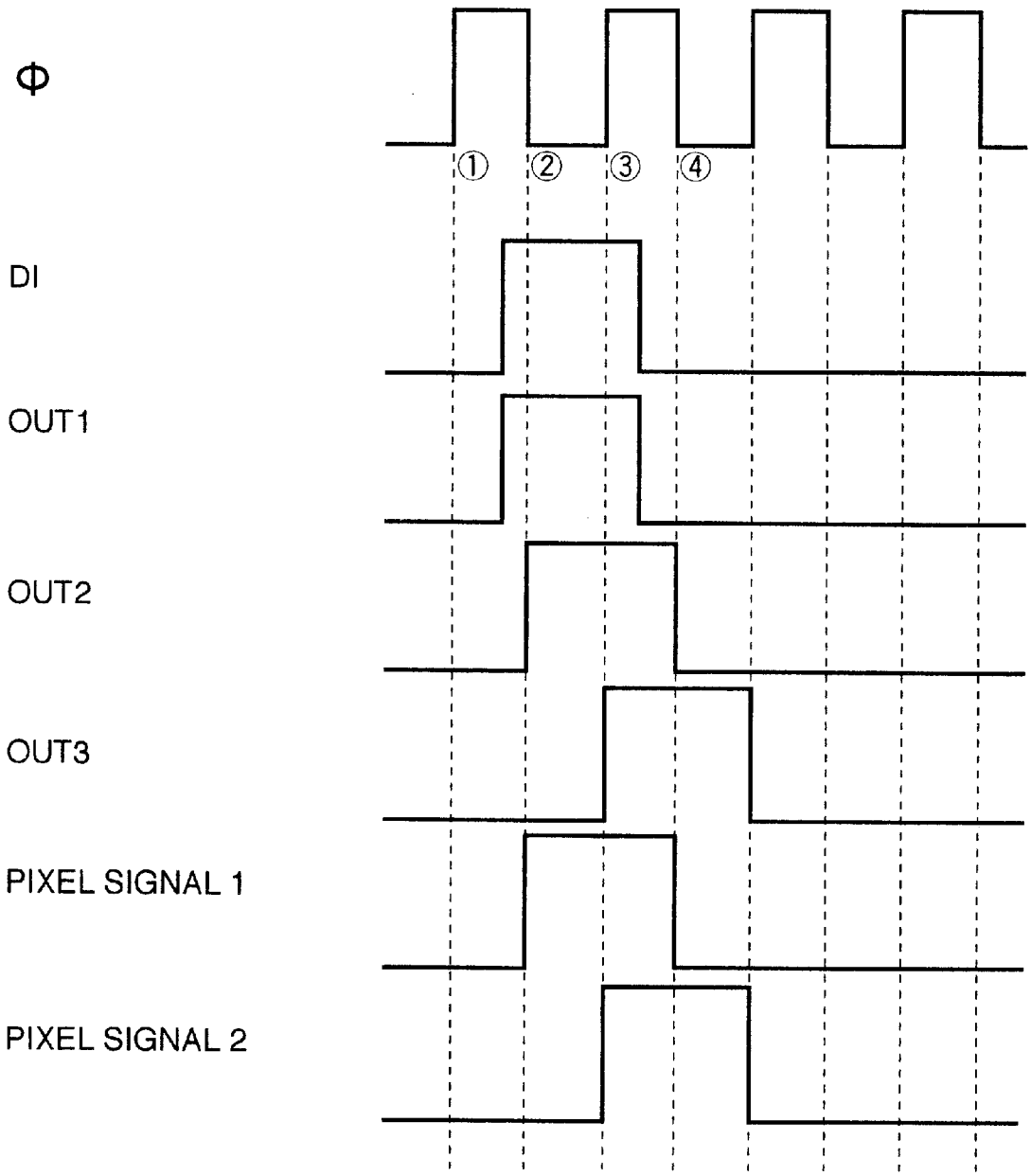
FIG. 7 is a schematic timing chart for explaining an operation of the bidirectional shift register stages in FIGS. 5*a* and 5*b;*

FIG. 7 shows an example of a timing chart for the latch circuits 67, 68 shown in FIG. 5*c*. In FIG. 7, in general, rising and falling edges of an input signal DI are not synchronized with rising and falling edges of an arbitrary clock signal Φ, and thus, in this embodiment, the input signal DI changes to be at H level later than the rising edge $\hat{1}$ of the clock signal Φ. Also, the input signal DI changes to be at L level later than a rising edge $\hat{3}$ of the clock signal Φ.

Since the latch circuit 67 in the preceding stage latches an input at the time when the clock signal Φ bar is at H level, the level of an output OUT1 changes with the same timing as that of the input signal DI. Meanwhile, the latch circuit 68 in the subsequent stage outputs H level of the output OUT1 at a falling edge $\hat{2}$ of the clock signal Φ, latches the H level output at the rising edge $\hat{3}$ of the clock signal Φ to hold it until the falling edge $\hat{4}$ of the clock signal Φ and further outputs L level of the output OUT1 at a falling edge $\hat{4}$ of the clock signal Φ. This situation, concerning an output OUT2 and afterwards, brings about outputs synchronized with the rising and falling edges of the clock signal Φ.

A latch circuit, which exists in a preceding stage (the first stage) in each of the HSR stage for the horizontal shift register 20 and the VSR stages for the vertical shift register 30, is not synchronized with a clock signal. On account of this, among the horizontal and the vertical scanning bidirectional shift register stages connected in series, i.e. HSR1, HSR2, . . . , HSR513 (the HSR stages) and VSR1, VSR2, . . . , VSR386 (the VSR stages), a latch circuit existing in a preceding stage of a HSR stage which serves as an input section of the horizontal shift register 20 and a latch circuit in a preceding stage of a VSR stage which serves as an input section of the vertical shift register 30 are used as dummy latch circuits (which function to synchronize a signal inputted into the register circuits 20, 30 with the clock signal). An output from the dummy latch circuit is not utilized, and thus it need not be connected to an outputting circuit.

As shown in FIGS. 2*a*, 3 and 4, the plurality of bidirectional shift register stages, i.e. HSR1, HSR513 and VSR1, . . . , VSR386, are provided continuously. Accordingly, as shown in FIG. 7, after the output OUT2 is outputted, output signals are also outputted from the bidirectional shift register stages just as an output OUT3. In the case of the latch circuits 67, 68 shown in FIG. 5*c*, the latch circuit 68, at the falling edge $\hat{2}$ of the clock signal Φ, outputs an output of the preceding stage to the OUT2, and then latches the preceding stage output at the rising edge $\hat{3}$ of the clock signal Φ to hold it until the falling edge $\hat{4}$ of the clock signal Φ. Next, a latch circuit 67, which exists in a preceding stage in the next bidirectional shift register stage and is not illustrated, outputs, at the rising edge $\hat{3}$ of the clock signal Φ, the output at the preceding stage to the OUT3. On account of this, during a time period from the rising edge $\hat{3}$ to the rising edge $\hat{4}$ of the clock signal Φ, both the OUT2 and the OUT3 are equally switched to an output-ON state. At this time, if a single image signal line is used, there occurs a possibility that the same image signal is written into pixels corresponding to the OUT2 and the OUT3, i.e. the outputs from the bidirectional shift register stages HSRs. In the present embodiment, however, as illustrated in FIG. 3, the image signals are supplied in such a manner that they are divided into plural groups in time sequence just as being divided into a plurality of series of pixel signals 22, i.e. VID1 to VID4. This transaction prevents such a possibility from occurring.

Also, in the present embodiment, the number of the pixels in a horizontal direction is 1025 and the number of the pixels in a vertical direction is 769, both of which are odd-numbered. However, each of the horizontal scanning bidirectional shift register stages or each of the vertical scanning bidirectional shift register stages comprises a combination of a latch circuit 67 and a latch circuit 68. Moreover, the total number of the latch circuits 67 and the latch circuits 68 which constitute the horizontal shift register 20 or the vertical shift register 30 is even-numbered.

The object of this structure is to take the input signal DI at the same edge (rising edge or falling edge) as that of the clock signal Φ even when a scanning direction is inverted. Namely, in the case of the latch circuits 67, 68 shown in FIG. 5*c,* if the scanning direction is inverted, location of the latch circuit 67 in the preceding stage and the latch circuit 68 in the subsequent stage is also inverted. This, as shown in FIG. 5*d,* results in turn in which the latch circuits are arranged in an order of 68, 67 when seen from the right side. However, considering this turn of the latch circuits with an input side of the signal as a reference, even if the scanning direction is inverted, turn of the latch circuits in an order of 67, 68 remains unchanged. The latch circuit 67 in the preceding stage produces an output corresponding to an input thereto at a rising edge of the clock signal Φ and holds it at the falling edge, and the latch circuit 68 in the subsequent stage produces an output corresponding to an input thereto at a falling edge of the clock signal Φ and holds it at a rising edge. On account of this, if the total number of the latch circuits 67, 68 is odd-numbered, the edge of the clock signal Φ at which the input signal DI is taken will be different when the scanning direction is inverted.

Taking FIG. 4 as an example and considering the case in which the total number of the latch circuits 67, 68 is odd-numbered, when a scanning direction in FIG. 4 is a direction from top to bottom, the first stage becomes a latch circuit 67 and the scanning is started by a rising of the clock Φ. Meanwhile, when the scanning direction is a direction from bottom to top, the first stage becomes a latch circuit 68 and the scanning is started by a falling of the clock Φ. This gives rise to some problems: One of which is that, when displaying is performed using a liquid crystal panel which scans in an opposite direction simultaneously, such as a liquid crystal projector based on the three-plates system, it becomes necessary to adjust a timing between the clock Φ and an image signal. On account of this, in the horizontal shift register 20 and the vertical shift register 30, a latch circuit, which exists in a preceding stage in the first HSR stage or in the first VSR stage of the horizontal or vertical bidirectional shift register stages, i.e. HSR1, . . . , HSR513 or VSR1, . . . , VSR386, is regarded and used as a dummy latch circuit, thereby making the total number of the latch circuits 67, 68 even-numbered.

Incidentally, although the explanation for the bidirectional shift register stages has been given employing the case in which the latch circuits are arranged in the turn of 67, 68 from the input side, the registers perform an equivalent operation when employing a case in which the latch circuits are arranged in turn of 68, 67 as is illustrated in FIG. 5*a.* Also, although the explanation has been given assuming that the clock signal Φ is an arbitrary signal, it is obvious that the clock signal HCLK, which is used by the horizontal scanning bidirectional shift register stages (the HSR stages), differs in the period from the clock signal VCLK used by the vertical scanning bidirectional shift register stages (the VSR stages).

Next, the description will be given concerning a reset circuit for the bidirectional shift register stages. The horizontal shift register 20 in FIG. 3 is provided with a resetting transistor 28. By forcibly making inputs to the inverters 61, 62 be at H level, it will be possible to make an output of each of the bidirectional shift register stages be switched to L level regardless of the state of the clock signal Φ, to thereby compulsorily cease an output from the image signal supply circuit 21. This makes it possible to constantly maintain states of the bidirectional shift register stages, i.e. HSR1, . . . , HSR513, at the time of turning the power supply on, thus allowing a power supply electric current for the bidirectional shift register stages to be transiently decreased. This also makes it possible to narrow a line width of a power supply line for the shift register 20. Similarly, the vertical shift register 30 is provided with a resetting transistor 28. This allows an output of each of the shift register stages to be switched to L level and thus permits the image signal supply circuit 21 and vertical outputting circuit circuit 32 and the switching elements in the image display area 10 to be switched off, thereby making it possible to prevent a direct current from being applied to the liquid crystal.

Also, when outputting an image the standard pixel number of which is smaller than the pixel number of a liquid crystal panel, namely, for example, when displaying an image by VGA on a XGA panel, the horizontal shift register 20 is reset at the time when a horizontal scanning by VGA is over and the vertical shift register 30 is reset at the time when a vertical scanning by VGA is over, thereby making it possible to prevent the image from being displayed twofold on the remaining image display area.

Additionally, although a P type transistor is employed as the resetting transistor 28 so that the output of each of the bidirectional shift register stages, i.e. HSR1, . . . , HSR513 or VSR1, . . . , VSR386, is switched to L level, it is also possible to employ an N type transistor as the resetting transistor 28 in order to switch off the image signal supply circuit 21 and output circuit 32.

Figure 8:
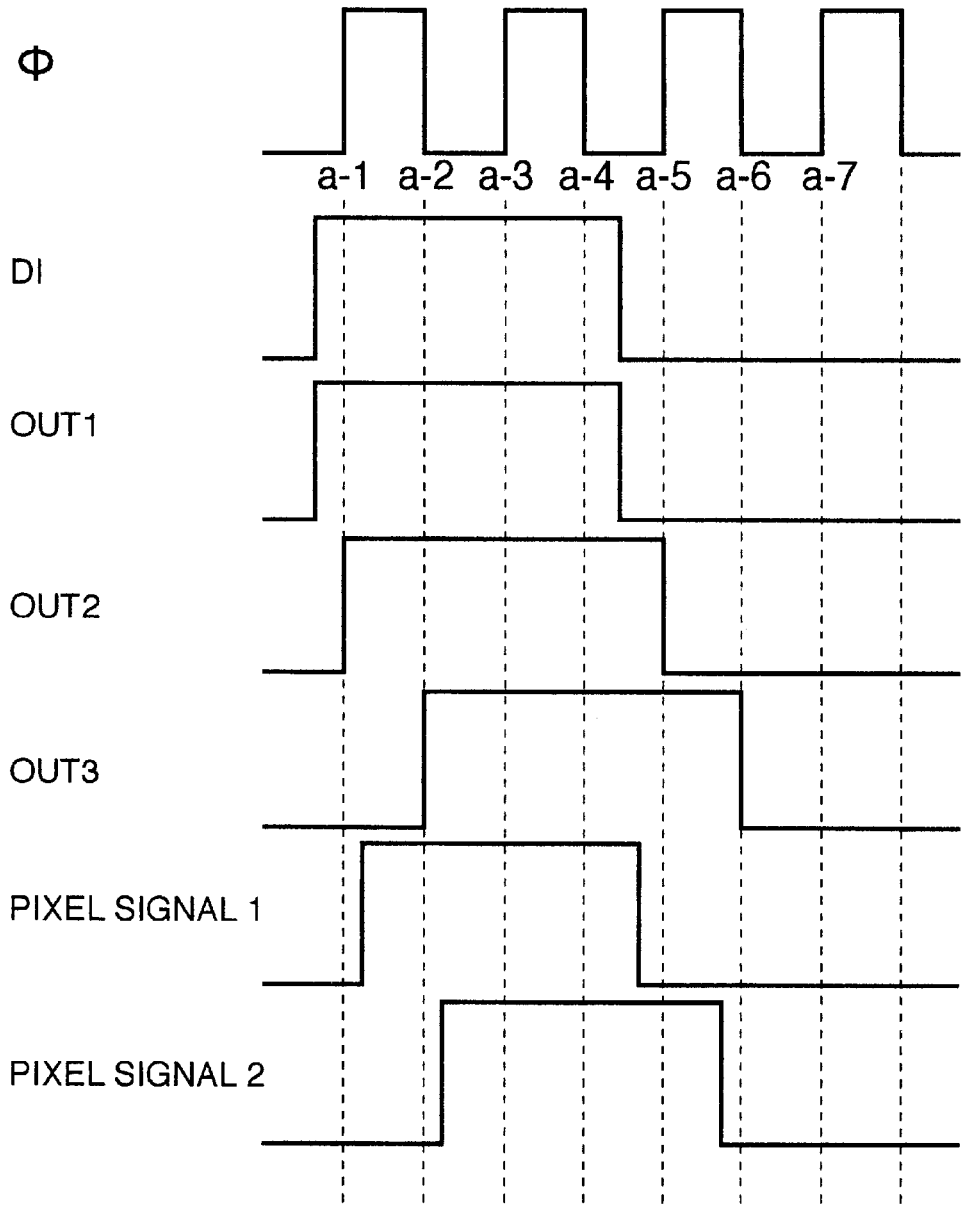
FIG. 8 is a schematic timing chart for explaining another operation of the bidirectional shift register stages in FIGS. 5*a* and 5*b;*

FIG. 8 shows a driving method which, when sampling of image signals is performed in advance in an external circuit and thus the image signals are divided into a plurality of series of pixel signals as shown in FIGS. 2*a,* 3, allows a time interval for ON states of the shift registers to be lengthened in harmony with a decrease in frequency of the image signals. In FIG. 8, a driving method of the bidirectional shift register stages, i.e. HSR1, HSR2, . . . , HSR513 in FIG. 5*a,* is explained employing, as the example, a case in which image signals are inputted for a time interval corresponding to two periods of the clock signal Φ. An input signal DI is inputted so that it remains at H level from a rising edge a-1 of the clock signal Φ to the falling edge a-4 thereof. On account of this, an output OUT1 remains at H level from the rising edge a-1 of the clock signal Φ to the falling edge a-4 thereof. This causes an output OUT2, which produces a state of the output OUT1 at a rising of the clock signal Φ and holds it at a falling edge, to remain at H level for a time interval from the rising edge a-1 to the rising edge a-5 corresponding to the two periods of the clock signal Φ. Similarly, concerning an output OUT3 and afterwards, too, H level continues to be outputted during the two periods of the clock signal Φ.

The above-described driving method, even when the image signals are inputted for a time interval corresponding to a plurality of periods of the clock signal Φ, makes it possible to lengthen an outputting time interval by the shift registers in harmony with the time interval for the image signals.

Figure 9:
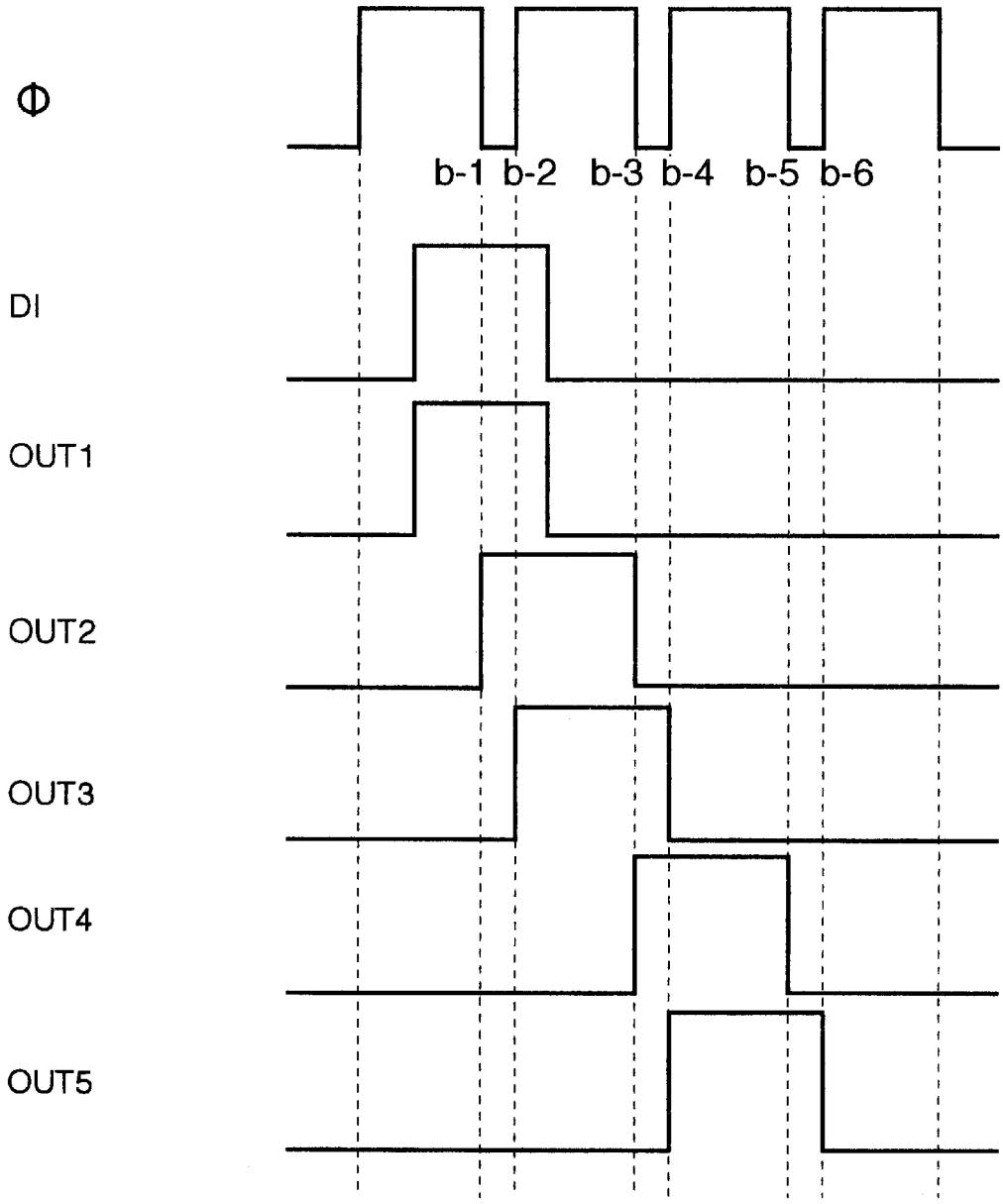
FIG. 9 is a schematic timing chart for explaining an operation of the bidirectional shift register stages in FIG. 5*a* at the time of changing a duty ratio of clock signals.

FIG. 9 shows an example of a timing chart for the vertical scanning bidirectional shift register stage in FIG. 5*b,* in which the duty ratio of the clock signal Φ is modified from the one indicated in FIG. 7 to the one indicated in FIG. 9. In FIG. 9, a time interval for L level of the clock signal Φ becomes shorter as compared with a time interval for H level thereof. Corresponding to a falling edge b-1 of the clock signal Φ, an output OUT2 changes to be at H level. Next, corresponding to a rising edge b-2 of the clock signal Φ, an output OUT3 changes to be at H level. Namely, since the duty ratio of the clock signal Φ is set in such a manner that the time interval for H level is longer and the time interval for L level is shorter, a time interval from the rising edge of the output OUT2 to the rising edge of the output OUT3 becomes shorter. In this way, modifying the duty ratio of the clock signal Φ results in a shift of the phase of the output OUT2 or OUT3 in FIG. 9 as compared with that of the output OUT2 or OUT3 in FIG. 8.

Moreover, corresponding to a falling edge b-3 of the clock signal Φ, an output OUT4 changes to be at H level, and, corresponding to a rising edge b-4 of the clock signal Φ, an output OUT5 changes to be at H level. At this time, since the duty ratio of the clock signal Φ is set in such a manner that the time interval for H level is longer and the time interval for L level is shorter, as is the case with the above-described, a time interval from the rising edge of the output OUT3 to the rising edge of the output OUT4 becomes longer and a time interval from the rising edge of the output OUT4 to the rising edge of the output OUT5 becomes shorter.

Figure 10:
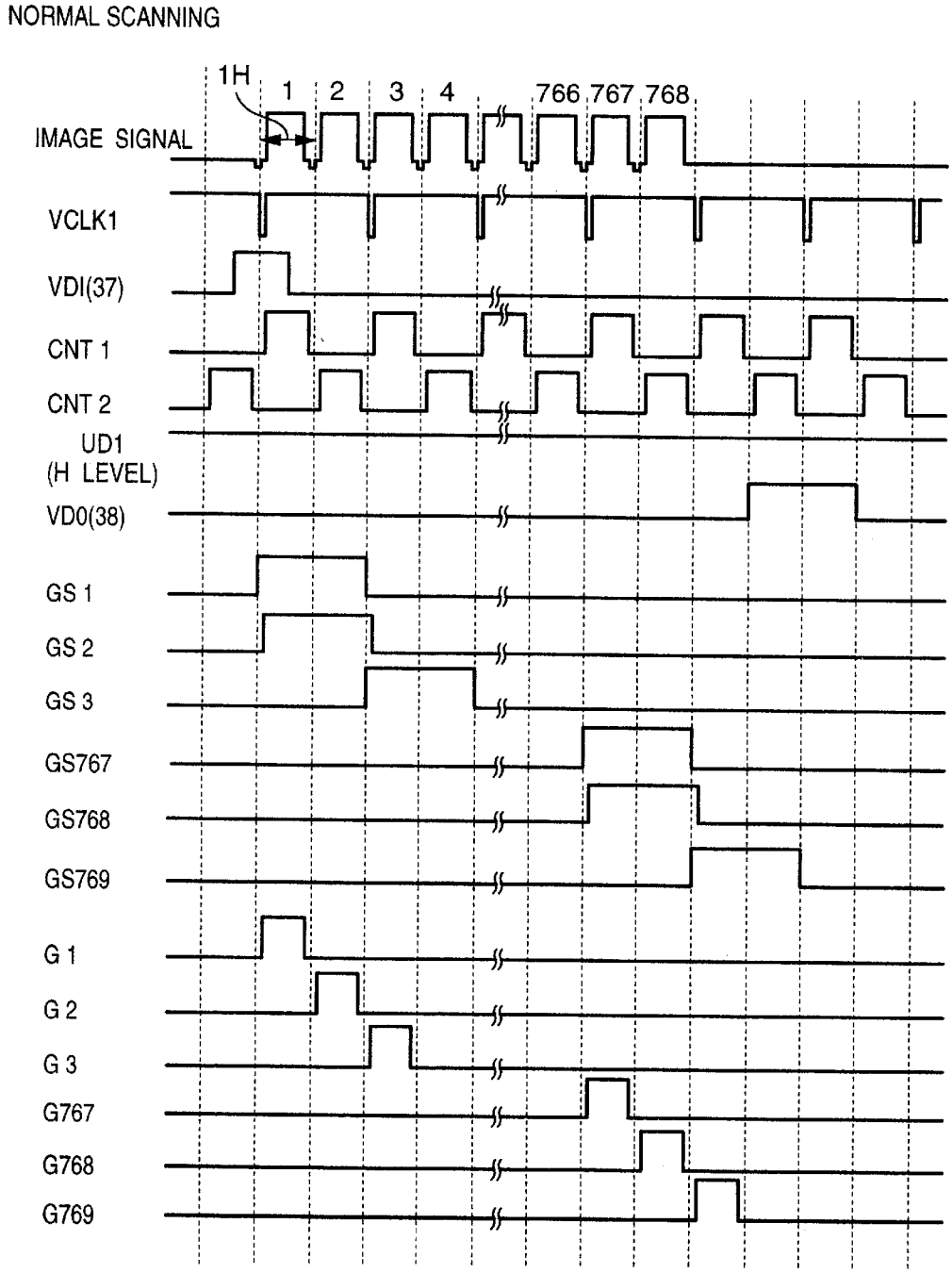
FIG. 10 is a schematic timing chart for explaining a normal scanning operation of a liquid crystal display apparatus according to an embodiment of the present invention.
Figure 11:
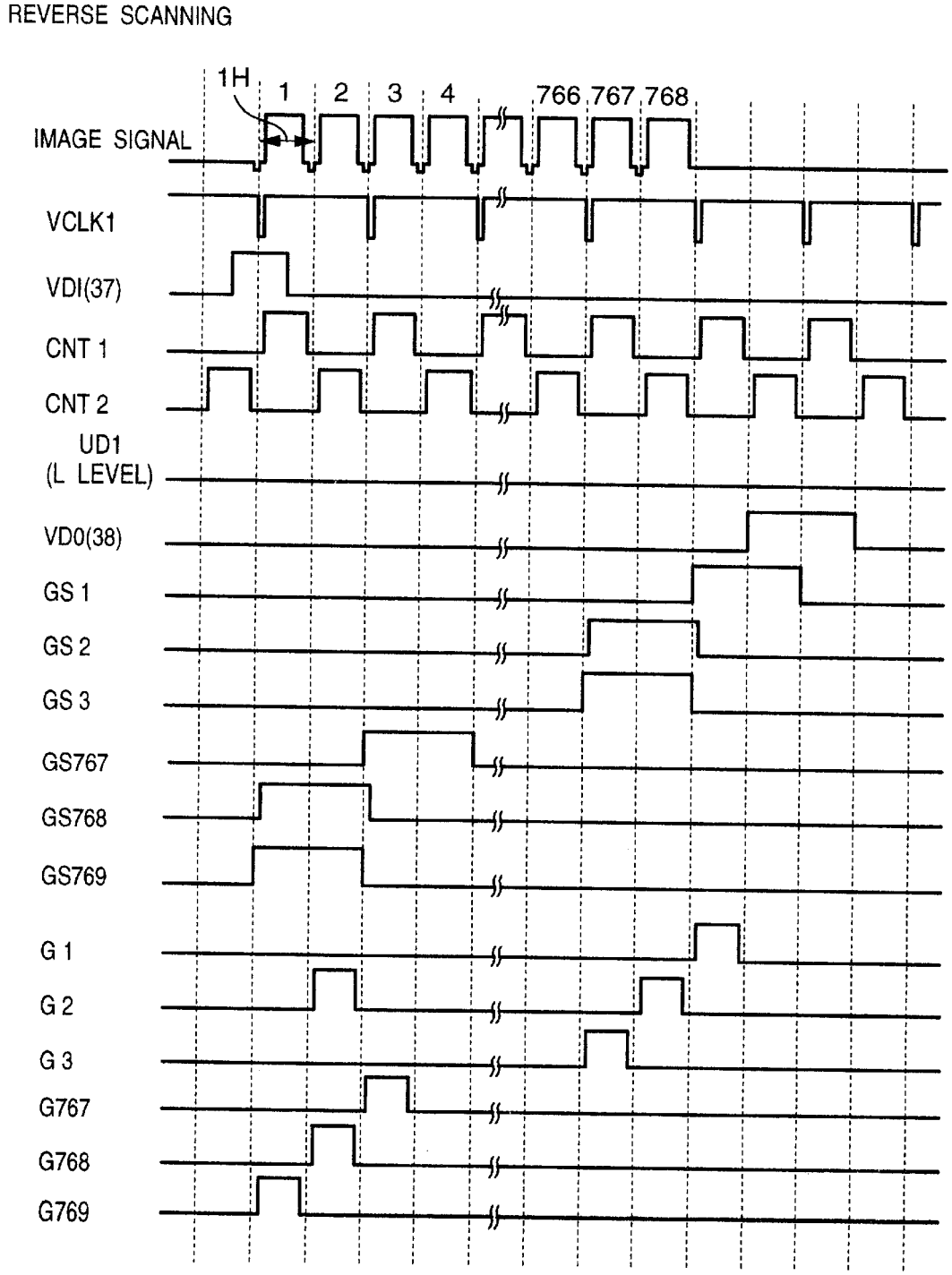
FIG. 11 is a schematic timing chart for explaining a reverse scanning operation of a liquid crystal display apparatus according to an embodiment of the present invention.

FIGS. 10, 11 are examples of timing charts for indicating a driving timing at the time when a sequential scanning driving is carried out. FIG. 10 shows a normal direction scanning corresponding to a scanning performed in a direction from top to bottom in FIG. 4. In the image signal waveforms, 1H represents a horizontal scanning time interval by a single line. The latch circuit 67 shown in FIG. 5*c* latches or holds an input signal at a falling edge of the clock VCLK1, and the latch circuit 68 shown in FIG. 5*c* latches or holds an input signal at a rising edge of the clock VCLK1. In this embodiment, the duty ratio of the clock VCLK1 is changed to vary the phase of an output of the shift register for a pixel on an odd-numbered line and an even-numbered line.

The duty ratio of the clock VCLK1 is adjusted so that the time interval for L level becomes approximately within a horizontal blank time interval of the image signal. On account of this, an output GS1 from the bidirectional shift register stage VSR1, when an input signal (a scanning start signal) VDI is inputted as is illustrated in FIG. 10, assumes H level at a falling edge of the clock VCLK1, and holds it until the next falling edge of the clock VCLK1. Additionally, as described earlier using FIG. 7, the dummy latch circuit (which operates as a latch circuit the output of which is not extracted onto an outside of the bidirectional shift register stages) is provided in the first stage (the preceding stage) in the bidirectional shift register stage VSR1. An output GS2 from the bidirectional shift register stage VSR2 takes the H level output GS1 at a rising edge of the clock VCLK1, and continues to latch or hold the value until the next rising edge of the clock VCLK1.

A phase difference between the output GS1 and the output GS2 approximately becomes equal to a time interval for the L level of the clock VCLK1. At this time, signals illustrated in FIG. 10 are supplied to the vertical scanning control terminals CNT1, CNT2 (refer to FIGS. 2*a,* 4). The output GS1 is calculated in NAND circuits in the vertical scanning control terminal CNT1 and the vertical scanning control unit 33, and is then outputted as an output G1 from the outputting circuit 32. The output GS2 is calculated in the vertical scanning control terminal CNT2 and the vertical scanning control unit 33, and is then outputted as an output G2 from the outputting circuit 32.

FIG. 11 shows a timing chart for a sequential scanning in a reverse direction, for a scanning performed from bottom to top in FIG. 4. Incidentally, for the sequential scanning shown in FIGS. 10, 11, the duty ratio of the vertical clock signal VCLK is changed. However, similar outputs will be obtained from the output circuit by use of a clock signal having a duty ratio of 50% and a period of 2H.

Figure 12:
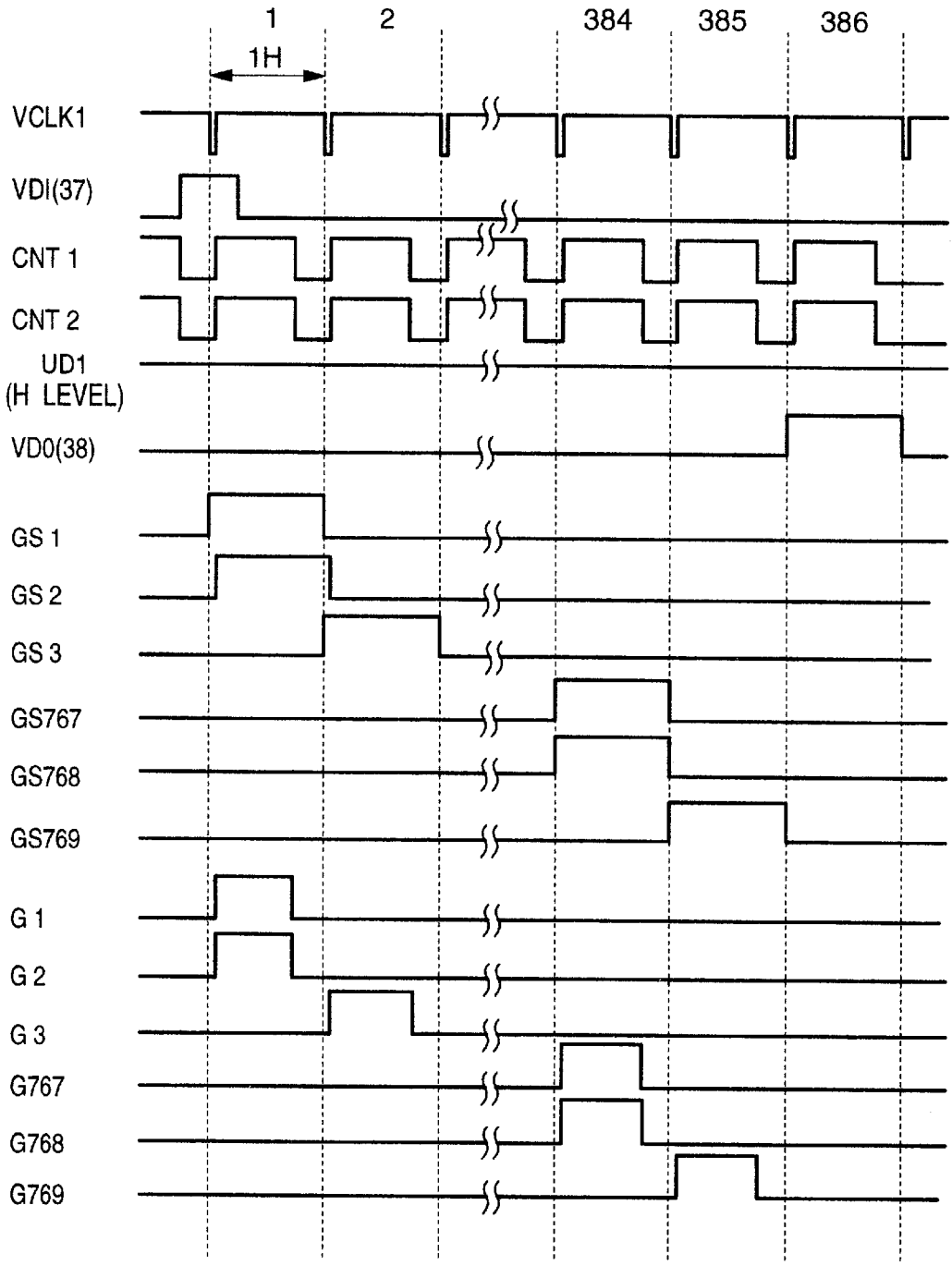
FIG. 12 is a schematic timing chart for explaining an operation of a two lines-simultaneous driving of a liquid crystal display apparatus according to an embodiment of the present invention.

FIG. 12 shows a timing chart at the time when (2n−1)th line and (2n)th line are simultaneously driven and image information on identical lines is supplied to the two scanning signal lines. This simultaneous driving is an operation required for dealing with input image signals the number of scanning lines of which is smaller than that of the scanning lines in the present embodiment. Additionally, here, reference symbol n denotes an integer. By supplying signals with identical phase to both of the vertical scanning control terminals CNT1 and CNT2, it becomes possible to simultaneously drive outputs G1 and G2 from the outputting circuit 32.

Figure 13:
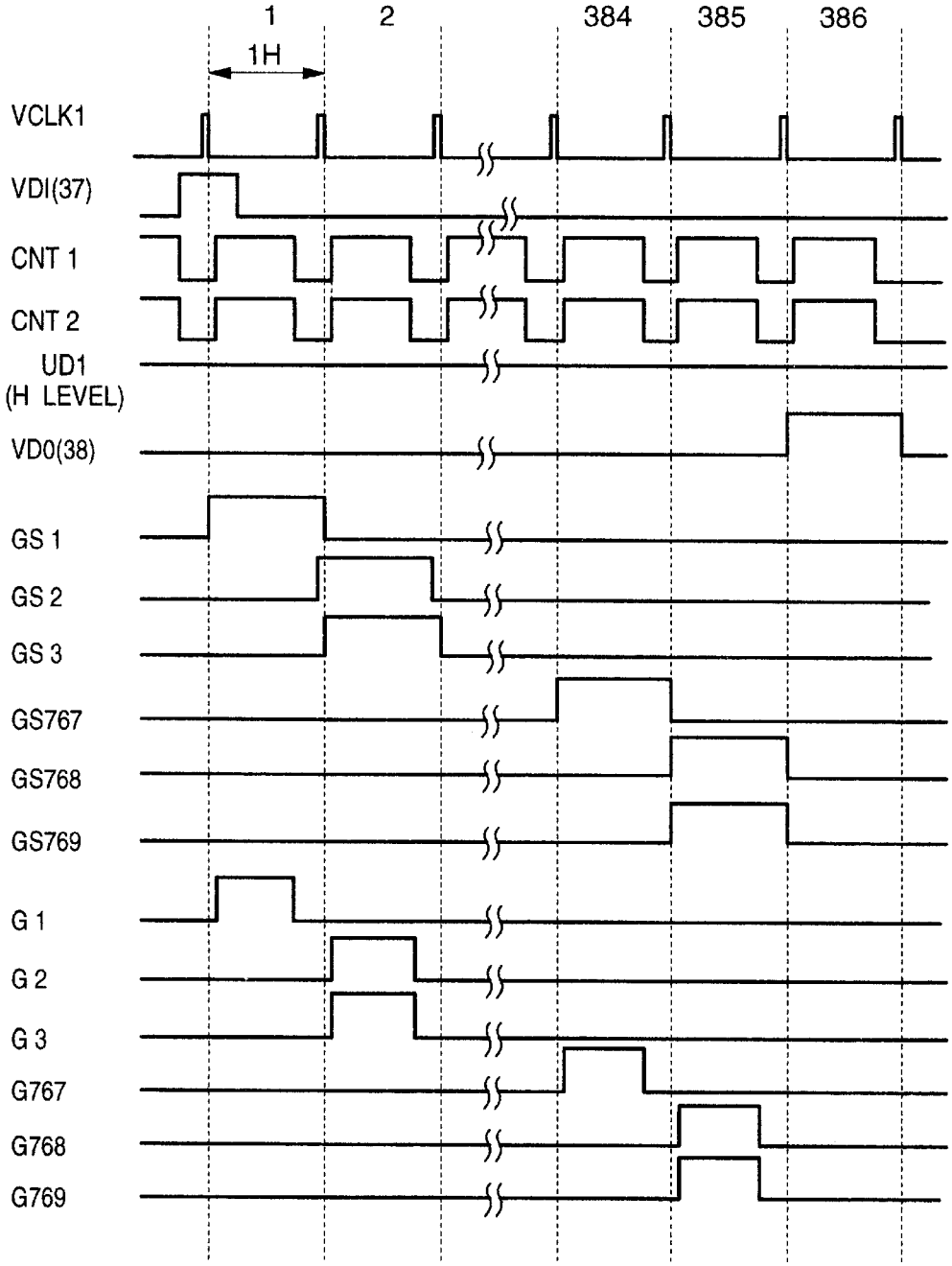
FIG. 13 is a schematic timing chart for explaining another operation of a two lines-simultaneous driving of a liquid crystal display apparatus according to an embodiment of the present invention.

FIG. 13 shows a timing chart at the time when (2n)th line and (2n+1)th line are simultaneously driven. A clock VCLK1 in FIG. 13 is inverted as compared with the clock VCLK1s in FIGS. 10 to 12, and a time interval for the H level thereof is approximately equal to the blank time interval of the horizontal image signal. The bidirectional shift register stage VSR1, at a falling edge of the clock VCLK1, takes H level output from the dummy latch circuit, i.e. the latch circuit 67 in the first stage in the shift register stage VSR1, and outputs the H level to an output GS1 (OUT2), and continues to latch the value until the next falling edge of the clock VCLK1. A latch circuit 67 in a first stage in the bidirectional shift register stage VSR2, at a rising edge of the clock VCLK1, takes H level output GS1, and outputs the H level to an output GS2, and continues to latch or hold the value until the next rising edge of the clock VCLK1. Then, a latch circuit 68 in a second stage in the vertical shift register stage VSR2, at the falling edge of the clock VCLK1, takes H level output GS2, and outputs the H level to an output GS3, and continues to latch or holds the value until the next falling edge of the clock VCLK1. Phase difference between the output GS1 and the output GS2 approximately becomes equal to the time interval for the L level of the clock VCLK1, and thus is approximately close to one period of the clock VCLK1. Phase difference between the output GS2 and the output GS3 approximately becomes equal to the time interval for the H level of the clock VCLK1. On account of this, the phase difference between the output GS2 and the output GS3 becomes shorter, and thus the output GS2 and the output GS3 are outputted with almost identical phase. Furthermore, for a time interval during which the output GS2 and the output GS3 are outputted almost simultaneously, by supplying signals with identical phase from the vertical scanning control terminals CNT1 and CNT2, it becomes possible to simultaneously drive outputs G2 and G3 from the outputting circuit 32.

Figure 14:
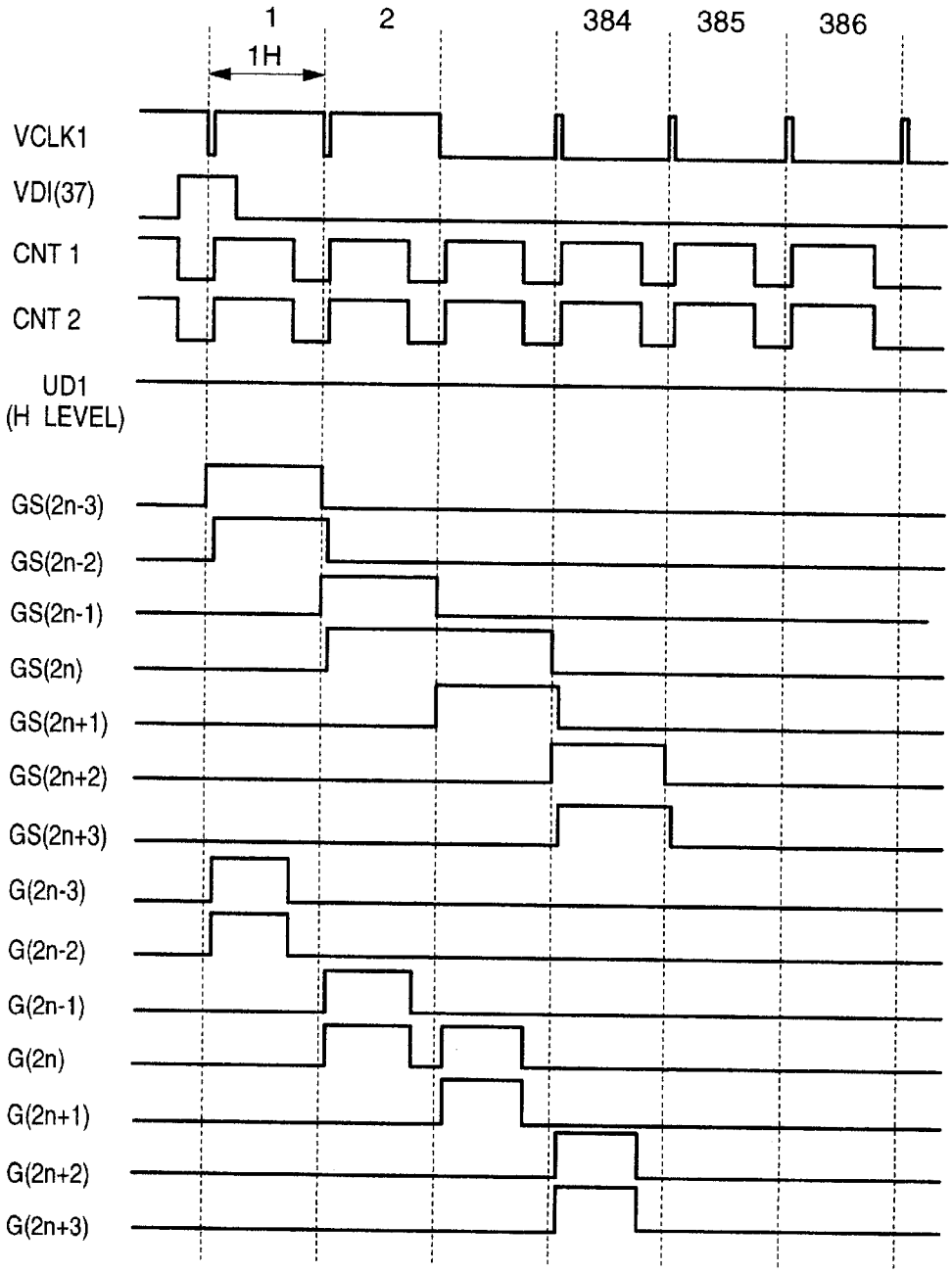
FIG. 14 is a schematic timing chart for explaining an operation of a line-skipped driving of a liquid crystal display apparatus according to an embodiment of the present invention.

FIG. 14 shows a driving method in which (2n−1)th line and (2n)th line are simultaneously driven, and then image information on the (2n)th line is skipped, and after that the (2n)th line and (2n+1)th line are simultaneously driven. A clock VCLK1 is inverted at an end of the (2n)th line so as to delay a rising of the clock VCLK1 by one period. On account of this, a time interval for H level of an output GS(2n) becomes close to two periods of the clock VCLK1. Then, signals with identical phase are supplied from the vertical scanning control terminals CNT1 and CNT2, and are calculated in the vertical scanning control unit 33. This causes the output GS(2n) to be outputted two times, thus making it possible to skip the (2n)th line from the two horizontal scanning signal lines which are being simultaneously driven.

Figure 15:
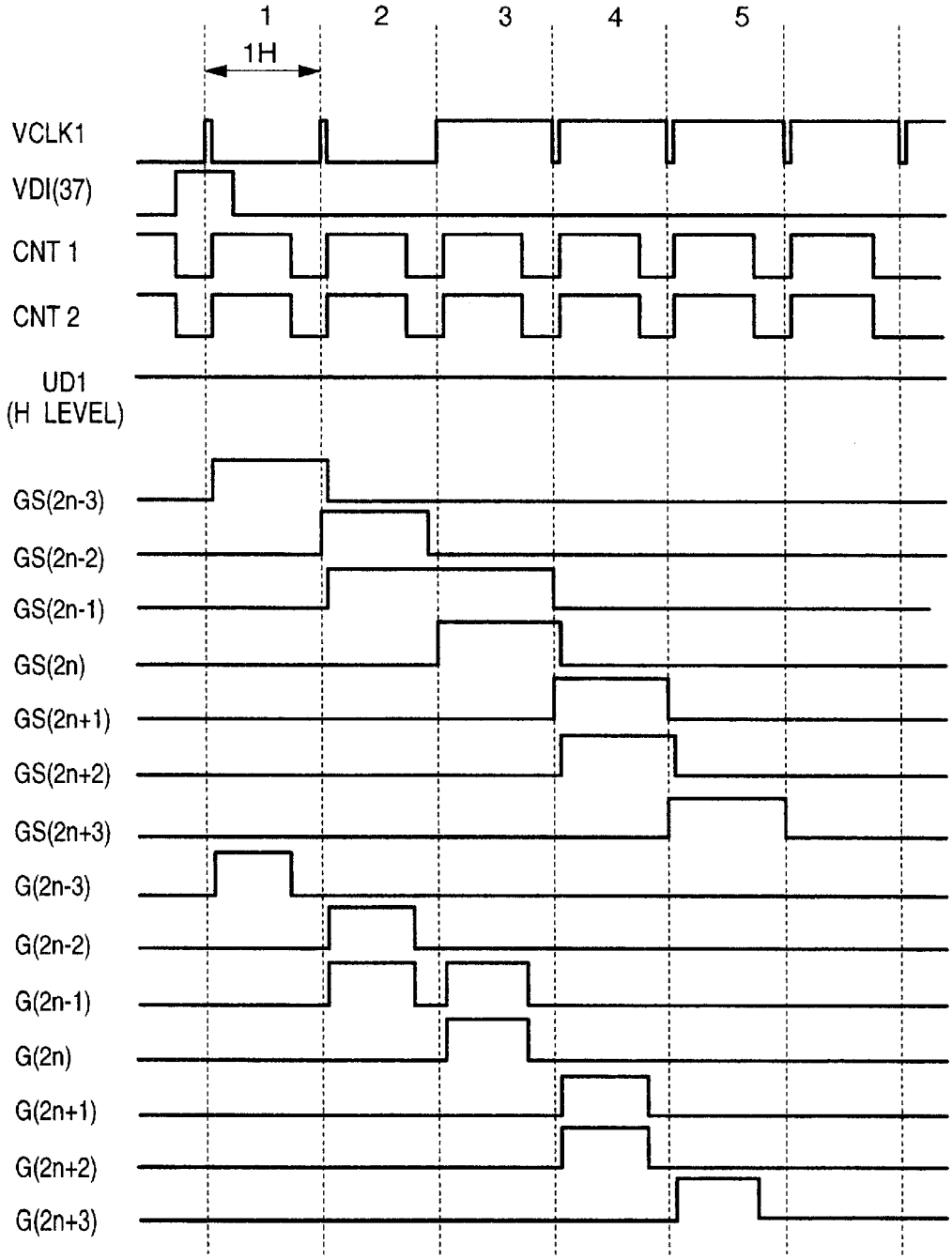
FIG. 15 is a schematic timing chart for explaining another operation of a line-skipped driving of a liquid crystal display apparatus according to an embodiment of the present invention.

FIG. 15 shows a driving method in which (2n−1)th line and (2n−2)th line of the horizontal scanning signal lines are simultaneously driven, and then image information on the (2n−1)th line is skipped, and after that (2n)th line and the (2n−1)th line are simultaneously driven.

Figure 1:
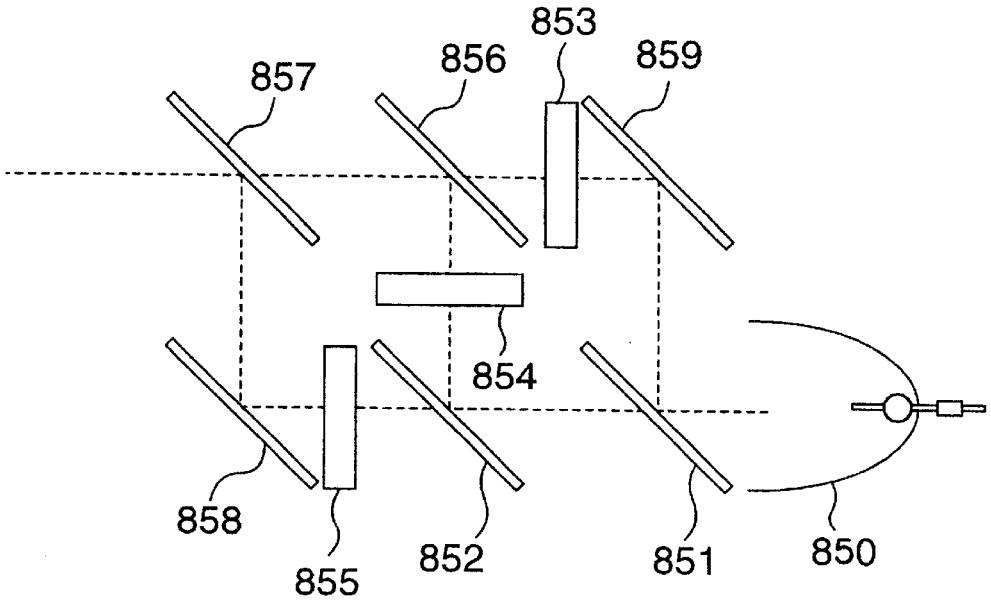
FIG. 1 is a schematic structural diagram for explaining a liquid crystal projector optical system based on a three-plates system.
Figure 16:
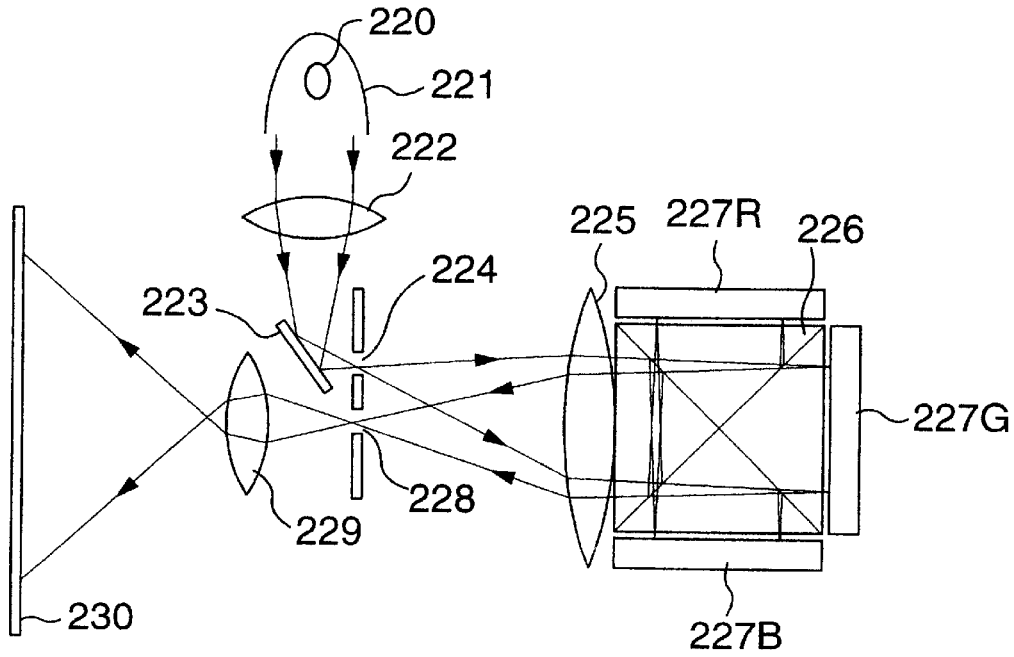
FIG. 16 is an illustrative diagram of an optical system which explains a liquid crystal projector according to an embodiment of the present invention.

FIG. 16 is an illustrative diagram of an optical system explaining a liquid crystal projector to which the liquid crystal display apparatus according to the present invention is applied. Reference numeral 220 denotes a light source, 221 a parabolic surface mirror, 222 a condenser lens, 223 a reflection mirror, 224 a first diaphragm, 225 a lens, 226 a dichroic prism, 227R a reflection type liquid crystal display apparatus for red color, 227G a reflection type liquid crystal display apparatus for green color, 227B a reflection type liquid crystal display apparatus for blue color, 228 a second diaphragm, 229 a projection lens, and 230 a screen. In the operation, a reverse scanning is performed in the horizontal direction or vertical direction for the green reflection type liquid crystal display apparatus 227G against, the red reflection type liquid crystal display apparatus 227R and the blue reflection type liquid crystal display apparatus 227B.

Figure 17:
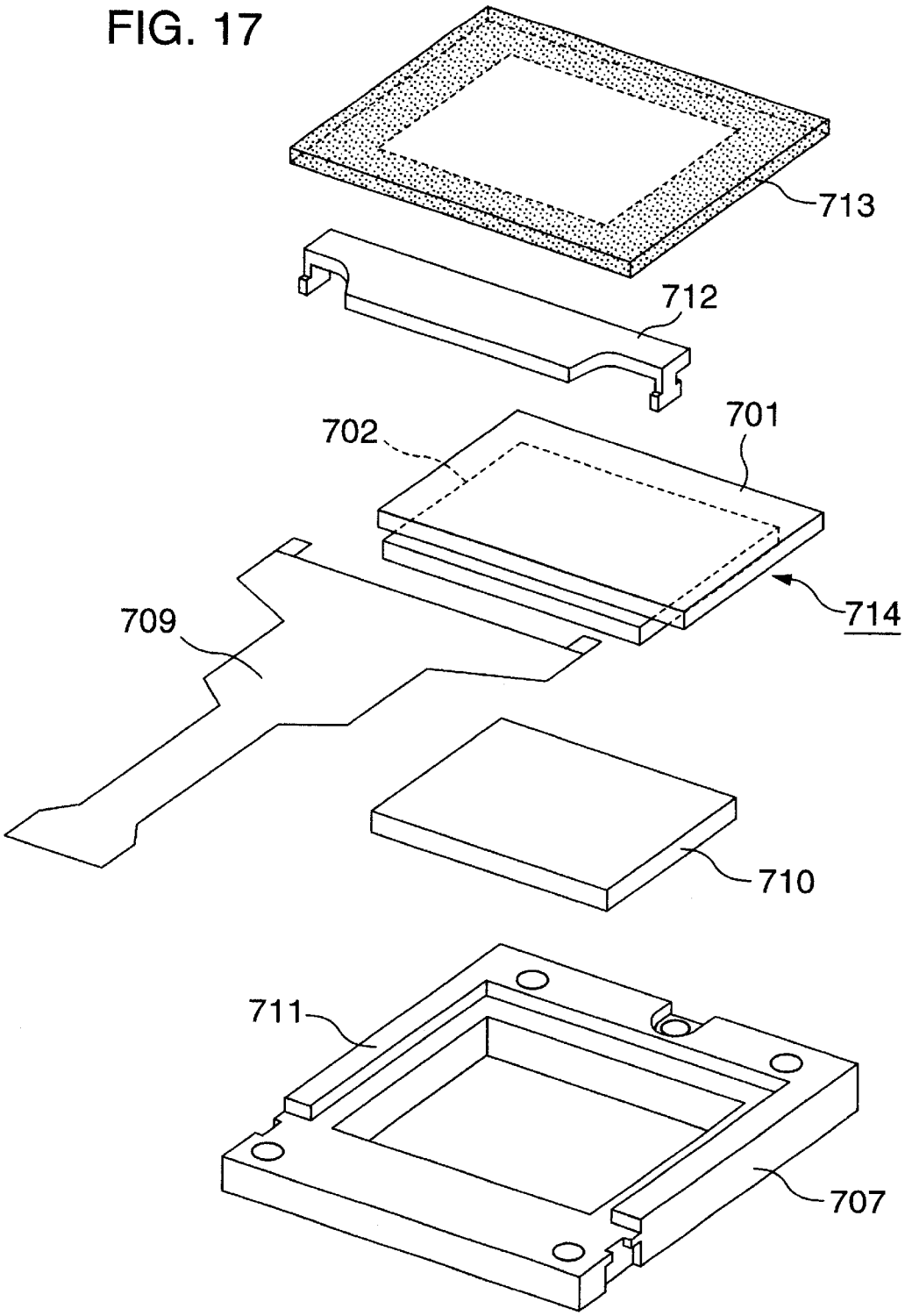
FIG. 17 is an exploded perspective diagram for explaining a structure of a liquid crystal display apparatus according to an embodiment of the present invention, in which a polymer dispersion type of liquid crystal is employed.

FIG. 17 is an exploded perspective diagram for explaining a case in which the liquid crystal display apparatus according to the present invention is applied to a polymer dispersion type liquid crystal (PDLC). Reference numeral 714 denotes a liquid crystal panel, 701 a transparent substrate, 702 a silicon substrate on which, together with pixel electrodes, a driving circuit for driving the pixel electrodes is provided and also the above-described horizontal shift register unit 20 and the vertical shift register unit 30 are formed. Although not illustrated, a liquid crystal layer is sandwiched between the transparent substrate 701 and the silicon substrate 702. Reference numeral 707 denotes a package, 709 a flexible printed circuit board for feeding a current to the liquid crystal panel 714, 713 a light-shielding frame, 712 a flexible printed circuit board holder, 710 a heat-dissipating sheet for dissipating heat in the liquid crystal panel 714 to the outside, and 711 a heat-dissipating board provided at the bottom of the package 707.

Figure 18A:
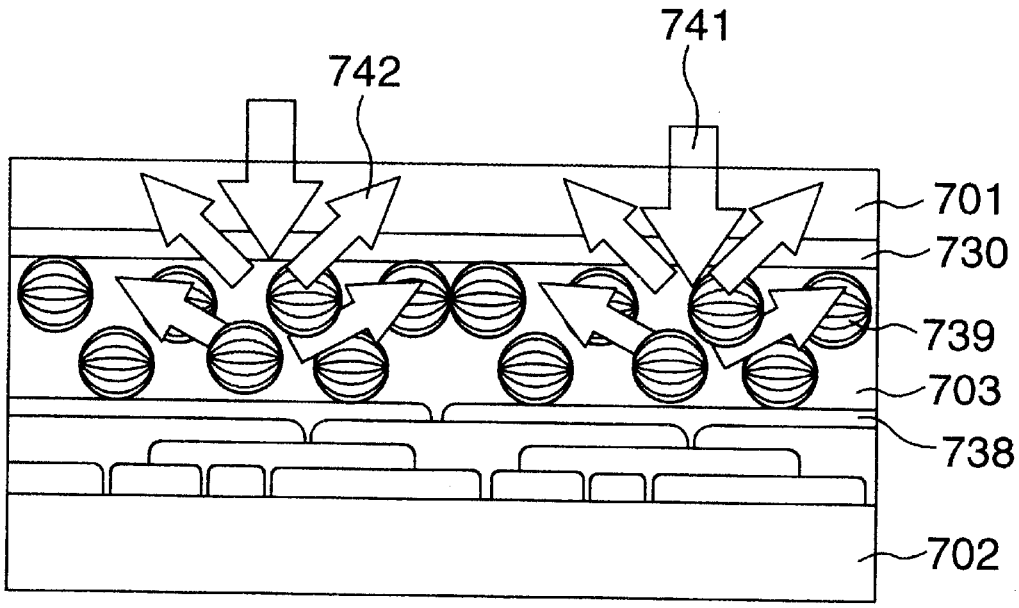
FIGS. 18*a* and 18*b* are schematic diagrams showing a cross-section of a liquid crystal display apparatus according to an embodiment of the present invention, in which a polymer dispersion type of liquid crystal is employed.
Figure 18B:
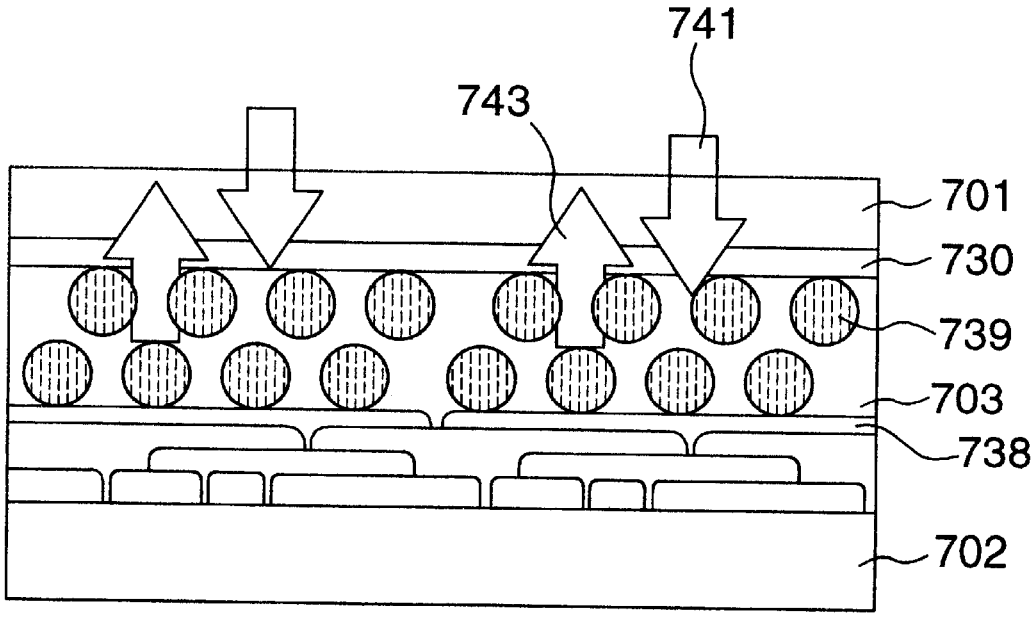

FIGS. 18*a,* 18*b* are schematic diagrams for illustrating cross-section of a liquid crystal display apparatus in which the present invention employs PDLC. The liquid crystal layer, which is the polymer dispersion type liquid crystal (PDLC) obtained by dispersing liquid crystals 739 into a macromolecule matrix 703, changes in correspondence with an applied voltage from a state in which light is scattered to a state in which light is allowed to pass through. FIG. 18*a* shows a manner in which light is scattered in the liquid crystal display apparatus applied to the liquid crystal projector, and FIG. 18*b* shows a manner in which light is reflected. Reflection pixel electrodes 738 are formed on the second substrate 702, and a transparent electrode 730 is formed on the first substrate 701.

As is illustrated in FIG. 18*a,* when no voltage is applied between the reflection pixel electrodes 738 on the second substrate 702 and the transparent electrode 730 on the first substrate 701, the liquid crystals 739 are oriented in an irregular direction, respectively. In this state, there occurs a difference in refractive index between the macromolecule matrix 703 and the liquid crystal molecules. Accordingly, incoming light 741 is scattered, thus producing scattered light 742. On the other hand, as is illustrated in FIG. 18*b,* when a voltage is applied between the reflection pixel electrodes 738 on the second substrate 702 and the transparent electrode 730 on the first substrate 701, all of the liquid crystals 739 are oriented in a fixed direction. Then, the refractive index of the liquid crystals 739 at the time when they are oriented in the fixed direction is made equal to the refractive index of the macromolecule matrix 703, thereby preventing the incoming light 741 from being scattered. The incoming light 741 not scattered is reflected regularly by the reflection pixel electrodes 738, thus producing reflected light 743.

As described above, the embodiment according to the present invention is capable of scanning bidirectionally, thus making it easier to invert and output an image. Moreover, the embodiment makes it unnecessary to newly provide means for inverting and outputting the image, thus allowing a compact liquid crystal display apparatus to be obtained.

What is claimed is:

1. A method of driving a liquid crystal display apparatus, the liquid crystal display apparatus including an array of pixels, a horizontal scanning circuit responsive to a horizontal scanning direction setting signal, a vertical scanning circuit responsive to a vertical scanning direction setting signal, an image signal supply circuit which receives pixel signals from an external source, the image signal supply circuit being connected to the array of pixels and being driven by the horizontal scanning circuit, and a vertical scanning control circuit connected to the array of pixels and being driven by the vertical scanning circuit, the vertical scanning circuit operating in cooperation with the horizontal scanning circuit to cause the pixel signals to be transferred from the image signal supply circuit to the array of pixels, each of the horizontal scanning circuit and the vertical scanning circuit including a series connection of bidirectional shift register stages, each of the bidirectional shift register stages including a first latch, a second latch, an intermediate output terminal, a first input/output terminal, and a second input/output terminal, the first latch being connected to the second latch through the intermediate output terminal, the first latch being connected through the first input/output terminal to a first one of two bidirectional shift register stages adjacent to a bidirectional shift register stage under consideration in the series connection of bidirectional shift register stages, the second latch being connected through the second input/output terminal to a second one of the two bidirectional shift register stages adjacent to the bidirectional shift register stage under consideration in the series connection of bidirectional shift register stages, the method comprising the steps of:

when scanning in a first direction with the horizontal scanning circuit, operating that bidirectional shift register stage which is located most upstream of the scanning in the first direction in the series connection of bidirectional shift register stages in the horizontal scanning circuit so that the first latch of that bidirectional shift register stage does not supply an output to the image signal supply circuit and the second latch of that bidirectional shift register stage does supply an output to the image signal supply circuit;

when scanning in a second direction with the horizontal scanning circuit, operating that bidirectional shift register stage which is located most upstream of the scanning in the second direction in the series connection of bidirectional shift register stages in the horizontal scanning circuit so that the second latch of that bidirectional shift register stage does not supply an output to the image signal supply circuit and the first latch of that bidirectional shift register stage does supply an output to the image signal supply circuit;

when scanning in a first direction with the vertical scanning circuit, operating that bidirectional shift register stage which is located most upstream of the scanning in the first direction in the series connection of bidirectional shift register stages in the vertical scanning circuit so that the first latch of that bidirectional shift register stage does not supply an output to the vertical scanning control circuit and the second latch of that bidirectional shift register stage does supply an output to the vertical scanning control circuit; and when scanning in a second direction with the vertical scanning circuit, operating that bidirectional shift register stage which is located most upstream of the scanning in the second direction in the series connection of bidirectional shift register stages in the vertical scanning circuit so that the second latch of that bidirectional shift register stage does not supply an output to the vertical scanning control circuit and the first latch of that bidirectional shift register stage does supply an output to the vertical scanning control circuit.

2. A method according to claim 1, wherein each of the first latch and the second latch includes a reset terminal; and wherein the method further comprises the step of applying a reset signal to the reset terminal of each of the first latch and the second latch to reset each of the first latch and the second latch.

3. A method according to claim 1, wherein the horizontal scanning circuit and the vertical scanning circuit are driven by respective clock signals; and wherein the method further comprises the step of changing a duty ratio of at least one of the clock signals to vary an interval between a start of supply of an output from the intermediate output terminal and a start of supply of an output from the second input/output terminal, or to vary an interval between a start of supply of an output from the intermediate output terminal and a start of supply of an output from the first input/output terminal, in each of the bidirectional shift register stages in at least one of the horizontal scanning circuit and the vertical scanning circuit.

4. A method of driving a liquid crystal display apparatus, the liquid crystal display apparatus including, on a single substrate, an array of pixels, an image signal supply circuit which supplies pixel signals to the array of pixels, and a plurality of scanning circuits which output respective scanning signals for driving the image signal supply circuit, each of the scanning circuits being capable of scanning in a first direction and a second direction opposite to the first direction, each of the scanning circuits including a first input/output section serving as an output section of the scanning circuit for scanning in the first direction and serving as an input section of the scanning circuit for scanning in the second direction, a second input/output section serving as an output section of the scanning circuit for scanning in the second direction and serving as an input section of the scanning circuit for scanning in the first direction, and a reset circuit which brings the first input/output section into an off-state for scanning in the first direction and brings the second input/output section into an off-state for scanning in the second direction, the method comprising the steps of:

resetting the first input/output section and the second input/output section with the reset circuit;

when scanning in the first direction, shifting a signal supplied to the first input/output section to the second input/output section in accordance with a clock signal; and when scanning in the second direction, shifting a signal supplied to the second input/output section to the first input/output section in accordance with the clock signal.

5. A method according to claim 1, wherein each of the first input/output section and the second input/output section includes an input/output terminal;

wherein the first input/output section is connected to the second input/output section through an intermediate output terminal; and wherein the method further comprises the step of changing a duty ratio of the clock signal to vary an interval between a start of supply of an output from the intermediate output terminal and a start of supply of an output from the input/output terminal of the first input/output section, or to vary an interval between a start of supply of an output from the intermediate output terminal and a start of supply of an output from the input/output terminal of the second input/output section, in each of the scanning circuits.

6. A method of driving a liquid crystal display apparatus, the liquid crystal display apparatus including an array of pixels, a horizontal scanning circuit responsive to a horizontal scanning direction setting signal, a vertical scanning circuit responsive to a vertical scanning direction setting signal, an image signal supply circuit which receives pixel signals from an external source, the image signal supply circuit being connected to the array of pixels and being driven by the horizontal scanning circuit, and a vertical scanning control circuit connected to the array of pixels and being driven by the vertical scanning circuit, the vertical scanning circuit operating in cooperation with the horizontal scanning circuit to cause the pixel signals to be transferred from the image signal supply circuit to the array of pixels, each of the horizontal scanning circuit and the vertical scanning circuit including a series connection of bidirectional shift register stages, each of the bidirectional shift register stages including a first latch, a second latch, and intermediate output terminal, a first input/output terminal, and a second input/output terminal, the first latch being connected to the second latch through the intermediate output terminal, the first latch being connected through the first input/output terminal to a first one of two bidirectional shift register stages adjacent to a bidirectional shift register stage under consideration in the series connection of bidirectional shift register stages, the second latch being connected through the second input/outout terminal to a second one of the two bidirectional shift register stages adjacent to the bidirectional shift register stage under consideration in the series connection of bidirectional shift register stages, the method comprising the steps of:

when scanning in a first direction with either of the horizontal scanning circuit and the vertical scanning circuit, operating each of the bidirectional shift register stages with a clock signal so that the first latch shifts a first output via the intermediate output terminal to the second latch and the second latch shifts a second output via the second input/output terminal to the second one of the two bidirectional shift register stages adjacent to the bidirectional shift register under consideration in the series connection of bidirectional shift register stages;

when scanning in a second direction opposite to the first direction with either of the horizontal scanning circuit and the vertical scanning circuit, operating each of the bidirectional shift register stages with the clock signal so that the second latch shifts a third output via the intermediate output terminal to the first latch and the first latch shifts a fourth output via the first input/output terminal to the first one of the two bidirectional shift register stages adjacent to the bidirectional shift register stage under consideration in the series connection of bidirectional shift register stages;

when scanning in a first direction with the horizontal scanning circuit, operating that bidirectional shift register stage which is located most upstream of the scanning in the first direction in the series connection of bidirectional shift register stages in the horizontal scanning circuit so that the first latch of that bidirectional shift register stage does not supply an output to the image signal supply circuit and the second latch of that bidirectional shift register stage does supply an output to the image signal supply circuit;

when scanning in a second direction with the horizontal scanning circuit, operating that bidirectional shift register stage which is located most upstream of the scanning in the second direction in the series connection of bidirectional shift register stages in the horizontal scanning circuit so that the second latch of that bidirectional shift register stage does not supply an output to the image signal supply circuit and the first latch of that bidirectional shift register stage does supply an output to the image signal supply circuit;

when scanning in a first direction with the vertical scanning circuit, operating that bidirectional shift register stage which is located most upstream of the scanning in the first direction in the series connection of bidirectional shift register stages in the vertical scanning circuit so that the first latch of that bidirectional shift register stage does not supply an output to the vertical scanning control circuit and the second latch of that bidirectional shift register stage does supply an output to the vertical scanning control circuit; and when scanning in a second direction with the vertical scanning circuit, operating that bidirectional shift register stage which is located most upstream of the scanning in the second direction in the series connection of bidirectional shift register stages in the vertical scanning circuit so that the second latch of that bidirectional shift register stage does not supply an output to the vertical scanning control circuit and the first latch of that bidirectional shift register stage does supply an output to the vertical scanning control circuit.

7. A method according to claim 6, wherein each of the first latch and the second latch includes a reset terminal; and wherein the method further comprises the step of applying a reset signal to the reset terminal of each of the first latch and the second latch to reset each of the first latch and the second latch.

8. A method according to claim 6, wherein the horizontal scanning circuit and the vertical scanning circuit are driven by respective clock signals; and wherein the method further comprises the step of changing a duty ratio of at least one of the clock signals to vary an interval between a start of supply of an output from the intermediate output terminal and a start of supply of an output from the second input/output terminal, or to vary an interval between a start of supply of an output from the intermediate output terminal and a start of supply of an output from the first input/output terminal, in each of the bidirectional shift register stages in at least one of the horizontal scanning circuit and the vertical scanning circuit.

* * * * *